US011156951B2

(12) United States Patent
Kinukawa et al.

(10) Patent No.: US 11,156,951 B2
(45) Date of Patent: Oct. 26, 2021

(54) FIXING UNIT AND IMAGE FORMING APPARATUS

(71) Applicant: Canon Kabushiki Kaisha, Tokyo (JP)

(72) Inventors: Tatsuya Kinukawa, Kanagawa (JP); Sho Taguchi, Kanagawa (JP); Shoichiro Ikegami, Kanagawa (JP); Kouji Yasukawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/172,392

(22) Filed: Feb. 10, 2021

(65) Prior Publication Data

US 2021/0263461 A1 Aug. 26, 2021

(30) Foreign Application Priority Data

Feb. 20, 2020 (JP) ..... JP2020-026805

(51) Int. Cl.
*G03G 15/20* (2006.01)
*G03G 15/00* (2006.01)

(52) U.S. Cl.
CPC ..... *G03G 15/80* (2013.01); *G03G 15/2053* (2013.01); *G03G 15/2064* (2013.01)

(58) Field of Classification Search
CPC ..... G03G 15/80; G03G 15/2053; G03G 15/2064; G03G 2215/2035
See application file for complete search history.

(56) References Cited

U.S. PATENT DOCUMENTS

2010/0310267 A1* 12/2010 Shimura ..... G03G 15/80 399/69
2013/0195483 A1* 8/2013 Shimizu ..... G03G 15/5029 399/45
2018/0275592 A1* 9/2018 Shimazoe ..... G03G 15/80

FOREIGN PATENT DOCUMENTS

JP 2002049259 A 2/2002
JP 2011215538 A 10/2011
JP 2016024435 A 2/2016

OTHER PUBLICATIONS

Co-pending U.S. Appl. No. 17/174,514, filed Feb. 12, 2021.

* cited by examiner

*Primary Examiner* — Walter L Lindsay, Jr.
*Assistant Examiner* — Jessica L Eley
(74) *Attorney, Agent, or Firm* — Venable LLP

(57) ABSTRACT

A fixing unit includes a film with a tubular shape, a nip forming unit including a heater and configured to be in sliding contact with an inner surface of the film, the heater including a substrate made of metal, an insulating layer formed on the substrate, and a heating element arranged on the insulating layer and configured to generate heat when a first AC voltage is applied from an AC power supply connected thereto, a pressing member opposed to the nip forming unit with the film interposed therebetween and configured to form a nip portion with the film, and a voltage application circuit configured to apply a second AC voltage to the substrate with a waveform that takes a voltage value of an opposite polarity to the first AC voltage when the first AC voltage takes a peak value.

10 Claims, 20 Drawing Sheets

FIXING UNIT AND IMAGE FORMING APPARATUS

BACKGROUND OF THE INVENTION

Field of the Invention

The present disclosure relates to a fixing unit for fixing an image on a recording material and an image forming apparatus for forming an image on a recording material.

Description of the Related Art

An example of a fixing unit adopting a heat-fixing system that is installed in a printer or a copying machine of an electrophotographic system is equipped with a heater having a heating resistor provided on a substrate formed of ceramics or the like, a fixing film that moves while being in contact with the heater, and a pressure roller arranged to oppose the heater with the fixing film interposed therebetween. A recording material that bears an unfixed toner image is heated while being nipped and conveyed at a nip portion, i.e., a fixing nip portion, formed between the fixing film and the pressure roller, by which the toner image borne on the recording material is heated and fixed to the recording material.

According to the fixing unit adopting the above-mentioned heat-fixing system, there was fear that image defects as described below may occur by using a recording material that has been left standing for a long time in a high temperature and high humidity environment, during which time the recording material absorbs moisture and electric resistance thereof has been reduced. If the recording material is nipped by the fixing nip portion while transfer of toner image is performed, an AC voltage applied to heat the heater is transmitted to a transfer nip portion through the recording material and superposed to a transfer voltage applied to a transfer member. Thereby, transfer current that flows from the transfer member to an image bearing member is fluctuated by waveform components of the AC voltage, so that the transfer property becomes uneven, and as a result, image defects caused by stripe-like density unevenness that occurs in a sub-scanning direction of the image, hereinafter referred to as AC-induced banding, may appear.

Japanese Patent Application Laid-Open Publication No. 2011-215538 discloses providing a detection circuit for detecting a current flowing to a transfer member, and if fluctuation of the current detected by the detection circuit during transfer of a toner image to a recording material is greater than a predetermined value, determining that AC-induced banding has occurred and controlling a transfer voltage being applied to the transfer member.

However, according to the method disclosed in the above document, the transfer voltage may be varied even in a case where the transfer current is fluctuated by causes other than the AC voltage derived from the fixing unit, and there was a risk that controlling of the transfer voltage may not lead to a reduction of image defects.

SUMMARY OF THE INVENTION

The present disclosure provides a fixing unit and an image forming apparatus capable of suppressing AC-induced banding without controlling of a transfer voltage.

According to one aspect of the disclosure, a fixing unit includes a film with a tubular shape, a nip forming unit including a heater and configured to be in sliding contact with an inner surface of the film, the heater including a substrate made of metal, an insulating layer formed on the substrate, and a heating element arranged on the insulating layer and configured to generate heat when a first AC voltage is applied from an AC power supply connected thereto, a pressing member opposed to the nip forming unit with the film interposed therebetween and configured to form a nip portion with the film, wherein a recording material is nipped and conveyed by the nip portion so that an image formed by toner on the recording material is heated and fixed to the recording material, and a voltage application circuit configured to apply a second AC voltage to the substrate with a waveform that takes a voltage value of an opposite polarity to the first AC voltage when the first AC voltage takes a peak value.

According to another aspect of the disclosure, a fixing unit includes a film with a tubular shape, a nip forming unit including a heater and configured to be in sliding contact with an inner surface of the film, the heater including a substrate made of metal, an insulating layer formed on the substrate, and a heating element arranged on the insulating layer and configured to generate heat when an AC voltage is applied from an AC power supply connected thereto, a pressing member opposed to the nip forming unit with the film interposed therebetween and configured to form a nip portion with the film, wherein a recording material is nipped and conveyed by the nip portion so that an image formed by toner on the recording material is heated and fixed to the recording material, and a voltage application circuit configured to apply a constant DC voltage with respect to a potential of a grounded-side of the AC power supply or a voltage equivalent to the potential of the grounded-side of the AC power supply to the substrate.

Further features of the present invention will become apparent from the following description of exemplary embodiments with reference to the attached drawings.

DESCRIPTION OF THE EMBODIMENTS

Exemplary embodiments according to the present disclosure will be described with reference to the drawings.

First Embodiment (1) Image Forming Apparatus

Figure 1:
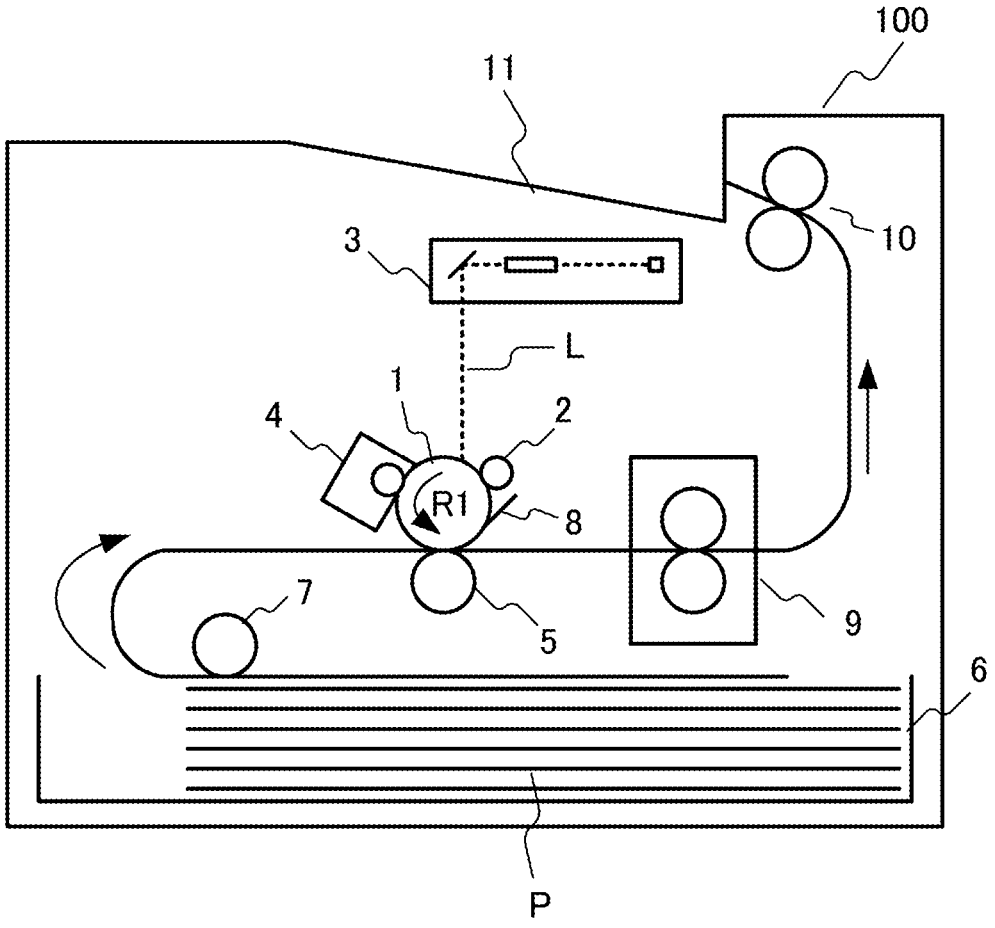
FIG. 1 is a schematic diagram illustrating an image forming apparatus according to a first embodiment.

FIG. 1 is a cross-sectional view of a laser beam printer, hereinafter simply referred to as printer 100, that adopts an electrophotographic technology and that serves as an image forming apparatus according to a first embodiment. Now, a configuration and operation of the printer 100 will be described briefly.

When a print command is received by the printer 100, a scanner unit 3 emits laser light L according to image information to a photosensitive member 1 serving as an image bearing member. The photosensitive member 1 charged to predetermined polarity by a charge roller 2 is scanned by laser light L, and an electrostatic latent image according to image information is thereby formed on a surface of the photosensitive member 1. Thereafter, toner is supplied to the photosensitive member 1 from a developing unit 4, and a toner image corresponding to the image information is formed on the photosensitive member 1. The toner image having reached a transfer portion, i.e., transfer nip portion, that has been formed between the photosensitive member 1 and a transfer roller 5 serving as a transfer unit along with the rotation of the photosensitive member 1 in the direction of arrow R1 is transferred onto a recording material P fed from a cassette 6 by a pickup roller 7. The surface of the photosensitive member 1 having passed the transfer nip portion is cleaned by a cleaner 8. The recording material P to which toner image t (FIG. 2) has been transferred is subjected to a fixing process by being heated and pressed in a fixing unit 9 of the heat-fixing system.

Thereafter, the recording material P is discharged onto a tray 11 by a sheet discharge roller 10. Various types of sheets of different sizes and materials may be used as the recording material P, such as paper including normal paper and thick paper, plastic films, cloth, coated paper and other sheet materials subjected to surface treatment, and sheets of special shapes such as envelopes and index paper. The present example is illustrated based on a system where toner image is directly transferred from the photosensitive member 1 to the recording material P, but it is also possible to apply the technique illustrated hereafter to an image forming apparatus that adopts a system where toner image formed on the photosensitive member is transferred to the recording material via an intermediate transfer member such as an intermediate transfer belt.

(2) Fixing Unit

The fixing unit 9 will now be described. The fixing unit 9 is a tensionless-type film heating system. That is, the fixing unit 9 uses a fixing film in the form of an endless belt, or a round tubular shape, having flexibility as a heat resistant film, and adopts a configuration where at least a part of the circumference of the fixing film is constantly tensionless and the fixing film rotates by rotational driving force of the pressing member.

Figure 2:
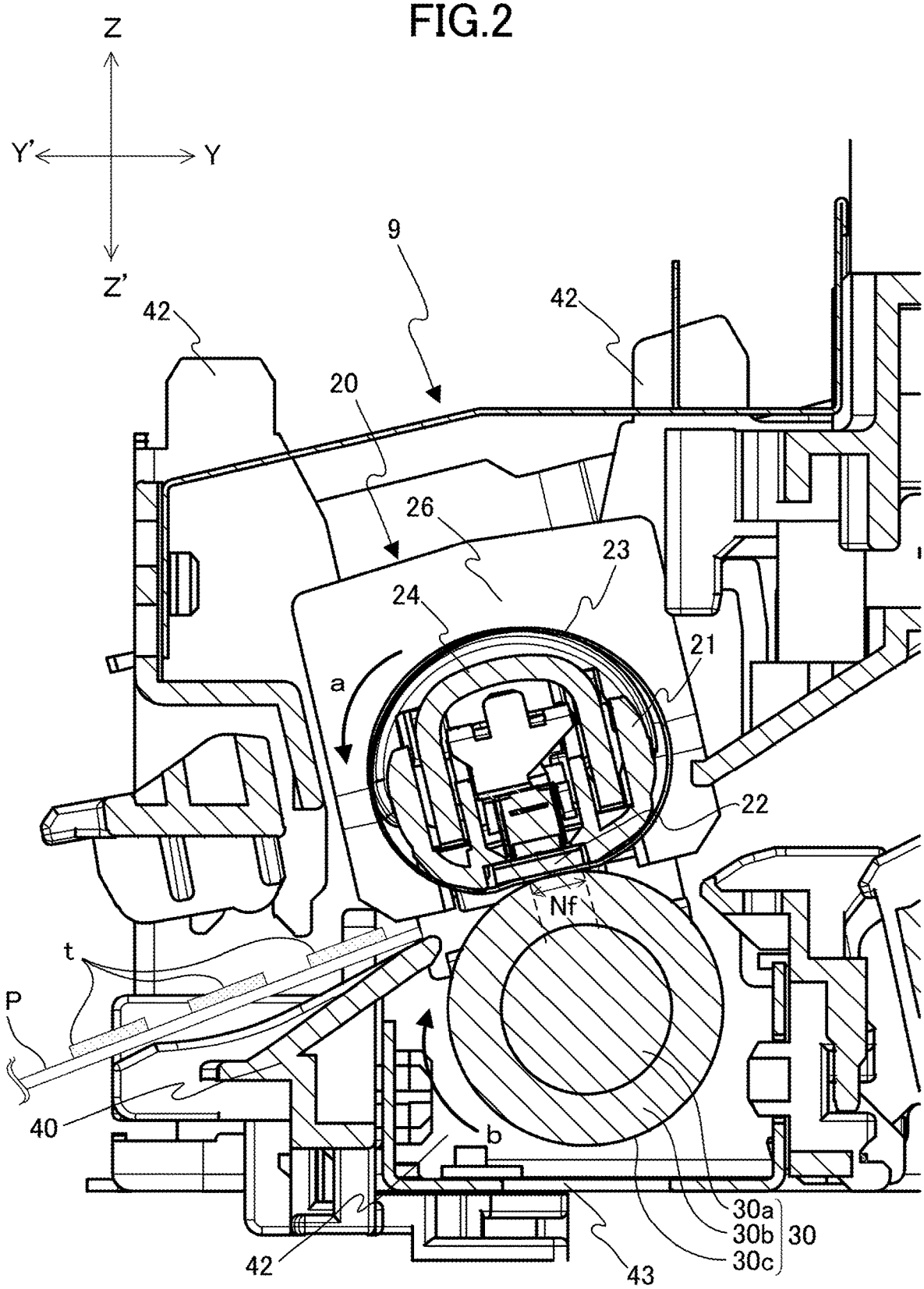
FIG. 2 is a cross-sectional view of a fixing unit according to the first embodiment.
Figure 3:
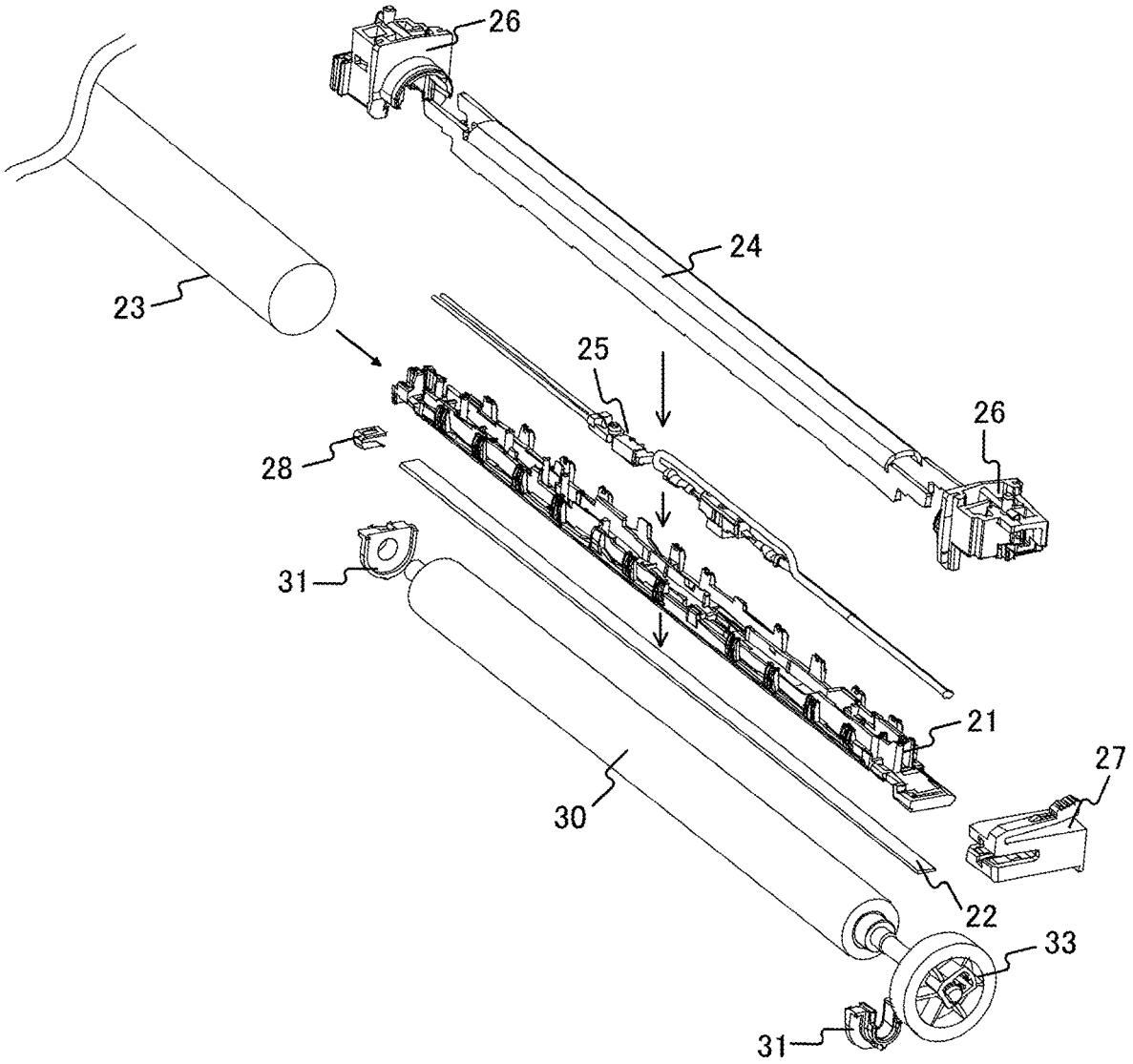
FIG. 3 is an exploded view of a film assembly used in the fixing unit according to the first embodiment.
Figure 4:
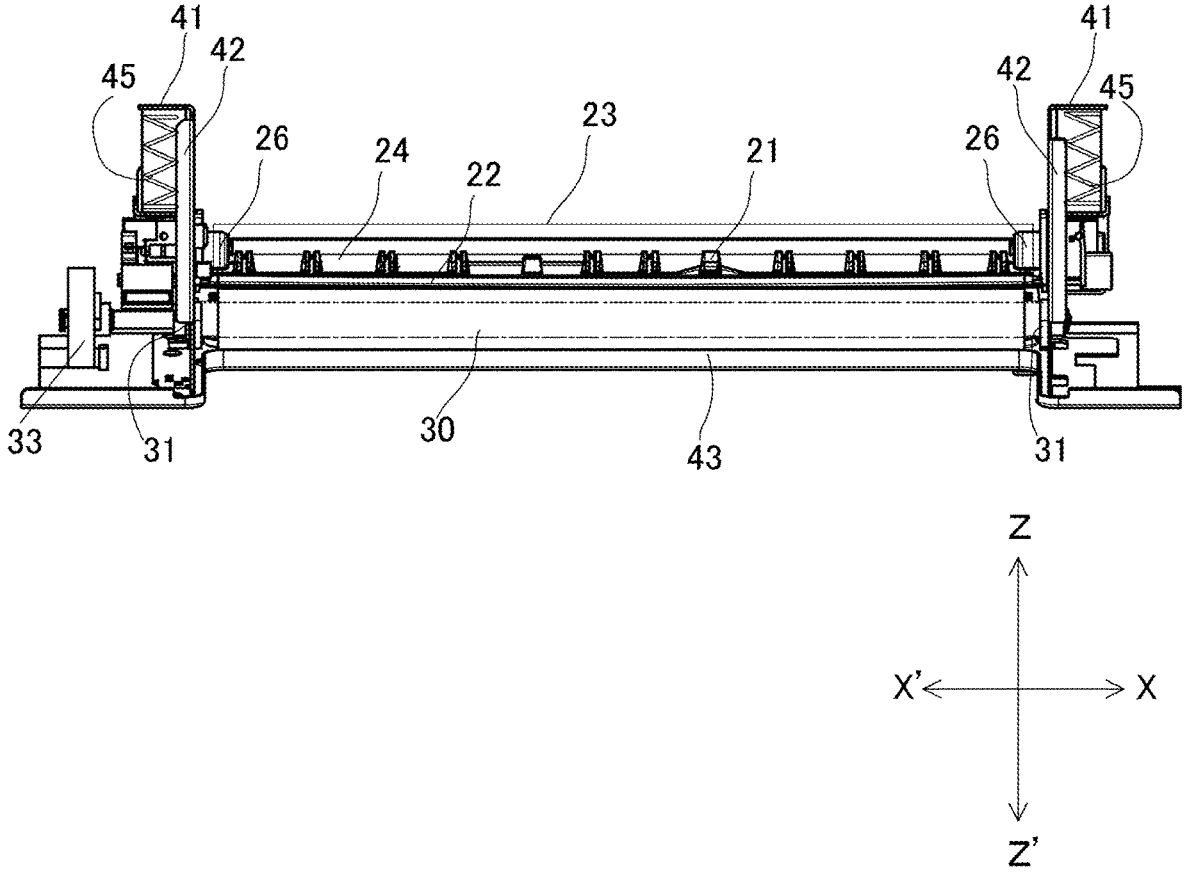
FIG. 4 is a front view illustrating a portion of the fixing unit according to the first embodiment.

Hereafter, the fixing unit 9 of the film heating system according to the present embodiment will be described in detail. FIG. 2 is a cross-sectional view of the fixing unit 9. FIG. 3 is an exploded perspective view of a film assembly 20 used in the fixing unit 9. FIG. 4 is a front view illustrating a portion of the fixing unit 9. In FIGS. 2 and 4, arrow X denotes a longitudinal direction of the fixing unit 9, arrow Z denotes upward in a vertical direction, and arrow Y denotes a direction perpendicular to the longitudinal direction and the vertical direction.

The fixing unit 9 according to the present embodiment includes, as illustrated in FIGS. 2 to 4, a fixing film 23 having a tubular shape, a heater 22 serving as a heating element and disposed inside the fixing film 23 to be in contact with an inner surface of the fixing film 23, and a pressure roller 30 serving as a pressing member that is pressed toward the heater 22 via the fixing film 23. A fixing nip portion Nf serving as a nip portion between the fixing film 23 and the pressure roller 30 is formed at a portion overlapped with an area where the heater 22 is in contact with the fixing film 23. The heater 22 is retained by a heater holder 21 which serves as a retaining member formed of heat-resistant resin. The heater 22 and the heater holder 21 function as a nip forming unit of the present embodiment for forming the fixing nip portion Nf. The heater holder 21 also functions as a guide for guiding rotation of the fixing film 23. The pressure roller 30 receives driving force from a motor and rotates in the direction of arrow b. The fixing film 23 is driven by following the rotation of the pressure roller 30 and rotates in the direction of arrow a.

The heater holder 21 is a molded component formed of heat-resistant resin such as PPS (polyphenylene sulfide) or liquid crystal polymer. The heater 22 includes a substrate mainly composed of a pure metal or an alloy and having an elongated plate shape, i.e., metal substrate, a resistance heating element, i.e., heating element, that generates heat by electric power conduction, an insulating layer for insulating the resistance heating element and the substrate, and a glass coat layer for protecting the heating element. The details of the heater 22 will be described later.

A thermistor 25 serving as a temperature detecting element is abutted against the heater 22 at an opposite side, that is, upper side in the drawing, from an abutting surface against the fixing film 23. By controlling the electric power conduction to the heating element in accordance with the detection temperature of the thermistor 25, the temperature of the fixing nip portion Nf is maintained at a set temperature suitable for fixing the image.

The thickness of the fixing film 23 should preferably be between 20 μm and 100 μm to ensure good thermal conductivity. A single-layer film formed of a material such as PTFE (polytetrafluoroethylene), PFA (tetrafluoroethylene-perfluoro alkyl vinyl ether copolymer) or PPS is suitable as the fixing film 23. Further, a composite layer film in which a surface of a base layer formed of a material such as PI (polyimide), PAI (polyamide imide), PEEK (polyether ether ketone) or PES (polyethersulfone) is coated with a material such as PTFE, PFA or FEP (tetrafluoroethylene-hexafluoropropylene copolymer) as a release layer, i.e., surface layer, is also suitable as the fixing film 23. Even further, it is also suitable to use a pure metal or an alloy having high thermal conductivity as the base layer, and to apply the aforementioned coating treatment and coating of a fluororesin tube to the release layer. Examples of the pure metal are Al, Ni, Cu and Zn, and examples of the alloy are a stainless steel and alloys of Al, Ni, Cu and Zn.

According to the present embodiment, PI having a thickness of 60 μm was used as the base layer of the fixing film 23, and coating of PFA having a thickness of 12 μm was provided as the release layer, considering both wear of the release layer by passing of sheets and thermal conductivity.

The pressure roller 30 serving as a pressing member, i.e., pressurizing rotary member, includes a core metal 30*a* formed of a material such as iron or aluminum, an elastic layer 30*b* formed of a material such as silicone rubber, and a release layer 30*c* formed of a material such as PFA (FIG. 2). The elastic layer 30*b* is formed on an outer circumference of the core metal 30*a*, and the release layer 30*c* is formed on an outer circumference of the elastic layer 30*b*, constituting an outermost layer of the pressure roller 30. A driving gear 33 (FIG. 3) is attached to one end portion in the axial direction of the core metal 30*a* of the pressure roller 30, and the pressure roller 30 rotates by receiving rotational driving force from a drive unit not shown via the driving gear 33.

The configuration of the fixing unit will now be described with reference to the cross-sectional view of FIG. 2. A reinforcement member 24 is formed of a metal such as iron, the member being provided to maintain strength so that the heater holder 21 will not deform greatly even when pressure is applied toward the pressure roller 30. The heater 22 is pressed toward the pressure roller 30 via the heater holder 21 and the reinforcement member 24 by a pressurizing member described later. An area where the pressure roller 30 and the fixing film 23 are in close contact with each other, i.e., pressure contact area, by the pressing force is referred to as the fixing nip portion Nf according to the present embodiment. A pressurizing position of the pressure roller 30, i.e., position of application point of pressing force of the heater 22 to the pressure roller 30, roughly corresponds to a position of a center portion of the heater 22 in a conveyance direction of the recording material.

Next, the present embodiment is described by referring to the perspective view of FIG. 3. The heater holder 21 has a gutter-like shape, i.e., U shape, in transverse section, and the reinforcement member 24 fits to an inner side of the gutter shape. A heater accommodating groove is provided on the heater holder 21 at a side opposed to the pressure roller 30, and the heater 22 is positioned at a desired position by fitting into the heater accommodating groove. The fixing film 23 is externally fit with circumferential margin to an outer side of the heater holder 21 to which the above-mentioned component has been assembled. An axial direction of the tubular shape of the fixing film 23, i.e., a direction of the arrow in which the fixing film 23 is inserted in the drawing, is referred to as a "longitudinal direction" of the fixing unit 9. In the present embodiment, the pressure roller 30, the heater 22 and the heater holder 21 are all long and narrow members that extend in the longitudinal direction.

Both end portions of the reinforcement member 24 in the longitudinal direction are projected portions that protrude from both ends of the fixing film 23, having flange members 26 and 26 respectively fit thereto. The fixing film 23, the heater 22, the heater holder 21, the reinforcement member 24 and the flange members 26 and 26 are assembled together as the film assembly 20.

A power feed terminal of the heater 22 is also protruded from one side in the longitudinal direction with respect to the fixing film 23, and a power feed connector 27 is fit to the power feed terminal. The power feed connector 27 is in contact with an electrode portion of the heater 22 with a certain contact pressure and constitutes a power supply path for supplying power fed from a commercial power supply to the heater 22.

A heater clip 28 is attached to the other side, that is, the side opposite to the power feed terminal, of the heater 22 in the longitudinal direction. The heater clip 28 is a metal plate that is bent in a U shape and has a spring property that enables the end portion of the heater 22 to be retained on the heater holder 21.

Next, the present embodiment is described with reference to the front view of FIG. 4. The respective flange members 26 and 26 regulate movement in the longitudinal direction of the fixing film 23 being driven to rotate, and thereby regulate the position of the fixing film 23 during operation of the fixing unit. A distance between flanges of the flange members 26 and 26, that is, parts coming into sliding contact with end portions of the fixing film, on both ends in the longitudinal direction is set longer than the length of the fixing film 23 in the longitudinal direction. This arrangement enables to prevent the end portions of the fixing film from being damaged during normal state of use.

Further, the length of the pressure roller 30 in the longitudinal direction is set approximately 10 mm shorter than the fixing film 23. This arrangement is adopted to prevent grease from leaking from ends of the fixing film 23 and adhering to the pressure roller 30, causing the pressure roller 30 to lose its gripping force on the recording material and slip.

The film assembly 20 is arranged to oppose to the pressure roller 30 and supported on a top-side casing 41 of the fixing unit 9 in a state where movement in the longitudinal direction, i.e., right-left directions in the drawing, is restricted and movement in the vertical direction is enabled. A pressurizing spring 45 serving as a pressurizing member is attached in a compressed manner to the top-side casing 41. The pressing force of the pressurizing spring 45 is received by the projected portion of the reinforcement member 24, and by having the reinforcement member 24 press against the pressure roller 30, the whole film assembly 20 is pressed against the pressure roller 30.

A bearing member 31 is provided to bear the core metal of the pressure roller 30 (refer also to FIG. 3). The bearing member 31 receives pressing force from the film assembly 20 via the pressure roller 30. In order to rotatably support the core metal of the pressure roller 30 that is heated to a relatively high temperature, the material of the bearing preferably has sufficient heat resistance and superior sliding property. The bearing member 31 is attached to a bottom-side casing 43 of the fixing unit.

The bottom-side casing 43 and the top-side casing 41 constitute a casing, i.e., frame member, of the fixing unit 9 together with frame side panels 42 and 42 that are provided on both sides in the longitudinal direction of the film assembly 20 and extend upward and downward.

(3) Heater

Next, materials constituting the heater 22 according to the present embodiment and a method for manufacturing the same will be described with reference to FIGS. 5 to 7.

Figure 5:
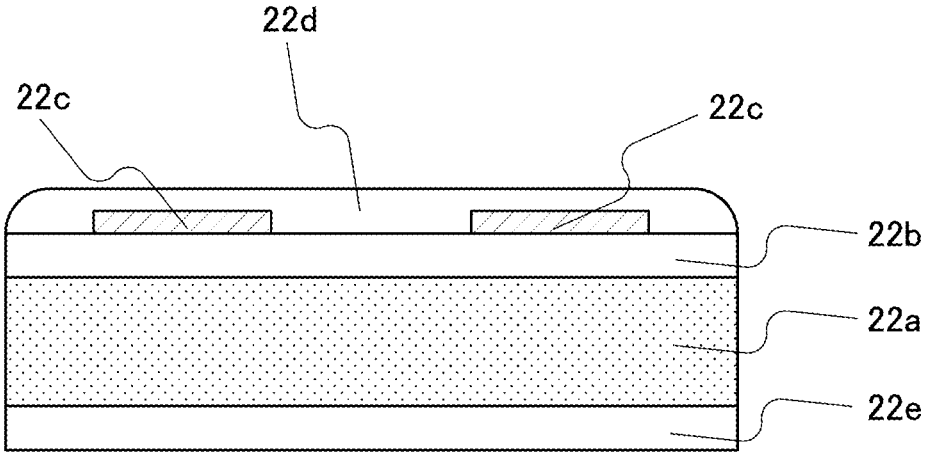
FIG. 5 is a cross-sectional view of a heater according to the first embodiment.

FIG. 5 is a cross-sectional view of the heater 22. The heater 22 includes a substrate 22*a* formed of metal, a heating element 22*c* serving as a heating resistance layer that generates heat by electric power conduction, an insulating layer 22*b* that insulates the heating element 22*c* and the substrate 22*a*, and a cover layer 22*d* such as a glass coating layer that protects the heating element. The substrate 22*a* is an elongated plate shape member formed mainly of a pure metal or an alloy. Further, in order to reduce warping of the substrate in manufacturing process, an insulating layer 22*e* is also provided on a surface (second surface) of the substrate 22*a* opposite to the surface (first surface) where the heating element 22*c* is provided in a thickness direction of the substrate 22*a*. The insulating layer 22*b* serves as a first insulating layer and the insulating layer 22*e* serves as a second insulating layer.

Materials such as stainless steel, nickel, copper or aluminum, or an alloy mainly composed of these metals are suitably used as the material for the substrate 22*a*. Among these materials, stainless steel is most preferable from the viewpoint of strength, heat resistance and corrosion. The type of stainless steel is not specifically limited, and any type can be selected as required considering necessary mechanical strength, linear expansion coefficient corresponding to the shape of the insulating layer and the heating element described in the next section, availability of the plate material in the market, and so on.

As an example, a martensitic- or ferritic-type chromium-containing stainless steel has a relatively low linear expansion coefficient among stainless steels and easily applied to forming an insulating layer and a heating element, so that it is suitable.

The thickness of the substrate 22*a* can be determined considering strength, heat capacity and radiation performance. A thin substrate 22*a* is advantageous for realizing a quick-start performance, that is, short time from starting of electric power conduction to reaching a target temperature of the heater 22, since it has a small heat capacity, but if it is too thin, a problem such as distortion of the substrate during sintering (firing) treatment of the heating resistor tends to occur. In contrast, a thick substrate 22*a* is advantageous from the viewpoint of preventing distortion of the heating resistor during thermoforming, but excessive thickness increases the heat capacity and is disadvantageous in realizing a quick start. Preferable thickness of the substrate 22*a*, considering the balance of mass productivity, cost and performance, is between 0.3 mm and 2.0 mm.

The material of the insulating layers 22*b* and 22*e* is not specifically limited, but it is necessary to select an insulating material having heat resistance in view of the actual temperature during use. The material of the insulating layers 22*b* and 22*e* is preferably glass or PI (polyimide) from the viewpoint of heat resistance, and in the case of glass, the actual powder material to be used should be selected within a range not deteriorating the characteristics of the present embodiment. A heat-conductive filler having an insulating property may be mixed as needed. There is no problem in using the same material or different materials for the insulating layers 22*b* and 22*e*. Similarly, the thickness may be the same within the insulating layers 22*b* and 22*e* or varied as needed.

In general, the heater 22 to be used in the image forming apparatus should preferably have a dielectric voltage of approximately 1.5 kV. Therefore, the thickness of the insulating layer 22*b* should be determined according to the material to realize a dielectric voltage performance of 1.5 kV between the heating element 22*c* and the substrate 22*a*.

The method for forming the insulating layers 22*b* and 22*e* is not specifically limited, but as an example, the insulating layers 22*b* and 22*e* can be formed smoothly by adopting screen printing. When forming an insulating layer of glass or PI (polyimide) on the substrate 22*a*, it is necessary to adjust the linear expansion coefficients of the substrate and the insulating layer material as required so that cracking and peeling do not occur in the insulating layer by the difference between linear expansion coefficients of the materials.

The heating element 22*c* is formed by printing a heating resistor paste having mixed (A) conductive component, (B) glass component and (C) organic binder component onto the insulating layer 22*b*, and then sintering the paste. When the heating resistor paste is sintered, the (C) organic binder component is burnt out and only components (A) and (B) are left, so that the heating element 22*c* containing the conductive component and the glass component is formed.

In the embodiment, materials such as silver-palladium (Ag—Pd) and ruthenium oxide ($RuO_2$) are used alone or in combination as the conductive component (A), and a sheet resistance of 0.1[Ω/□] to 100 [KΩ/□] is suitable. Materials other than those mentioned above in (A) to (C) can also be contained as long as the amount is subtle enough so as not to deteriorate the characteristics of the present embodiment.

Figure 6:
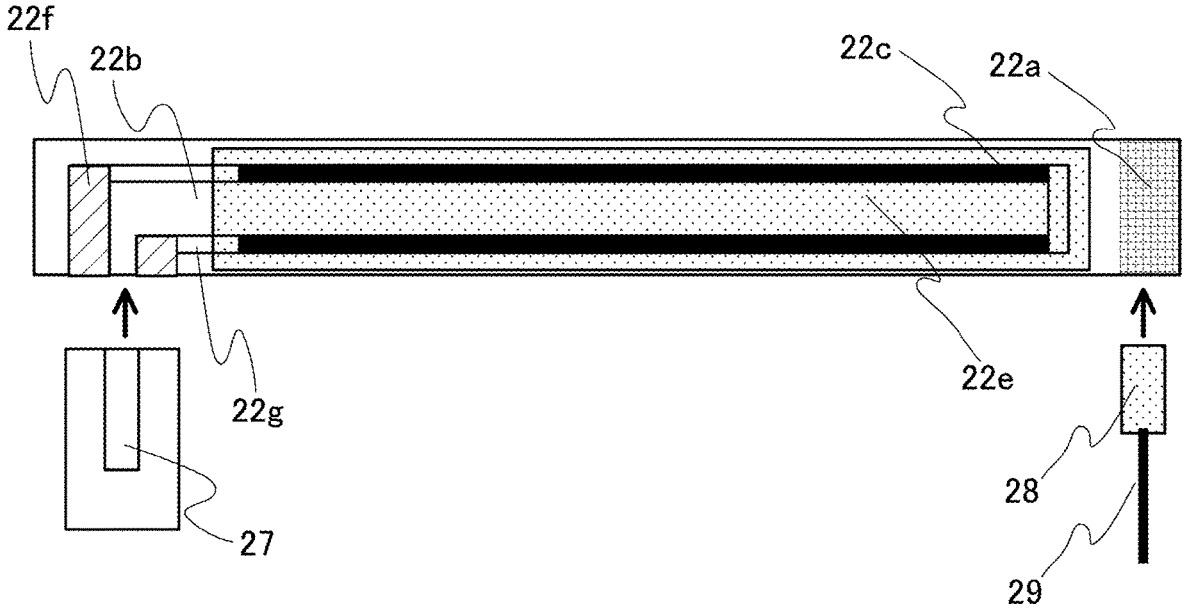
FIG. 6 is a schematic diagram illustrating a configuration for mounting the heater according to the first embodiment.

A power supplying electrode 22*f* and a conductive pattern 22*g* illustrated in FIG. 6 are mainly composed of a conductive component such as silver (Ag), platinum (Pt), gold (Au), silver-platinum (Ag—Pt) alloy or silver-palladium (Ag—Pd) alloy. The power supplying electrode 22*f* and the conductive pattern 22*g* are formed, similar to the heat resistor paste, by printing a paste having mixed (A) conductive component, (B) glass component and (C) organic binder component to the insulating layer 22*b*, and then sintering the same. The power supplying electrode 22*f* and the conductive pattern 22*g* are conductive parts that are provided to feed power to the heating element 22*c*, and the resistance is set sufficiently low compared to the heating element 22*c*.

Note that, it is necessary to select a material that softens and melts at a temperature lower than a melting point of the substrate 22*a* and a material that has sufficient heat resistance in consideration of the temperature during actual use as the aforementioned heating resistor paste and the paste for forming the power supplying electrode and conductive pattern.

As illustrated in FIG. 5, the cover layer 22*d* that covers the heating element 22*c* and the conductive pattern 22*g* are provided on the insulating layer 22*b* of the heater 22. In a case where the heating element 22*c* is arranged at a side of the substrate 22*a* that contacts the fixing film 23, that is, lower side of FIG. 2, the cover layer 22*d* exerts a protective function of ensuring an electrical insulating property between the heating element 22*c* and the fixing film 23 and ensuring a sliding property between the heating element 22*c* and the fixing film 23. The material of the cover layer 22*d* should preferably be glass or PI (polyimide) from the viewpoint of heat resistance, and a heat-conductive filler having an insulating property may be mixed thereto as needed.

In the present embodiment, a ferritic stainless-steel substrate (18 Cr stainless-steel) having a width (i.e., dimension in the short direction) of 10 mm, a length (i.e., dimension in the longitudinal direction) of 300 mm, and a thickness (i.e., dimension in the thickness direction) of 0.5 mm was prepared as the substrate 22*a*.

Next, the glass paste for forming the insulating layer was applied on the aforementioned stainless-steel substrate by screen printing, and then dried at 180° C. and sintered at 850° C. to form the insulating layers 22*b* and 22*e*. The thickness of the insulating layers 22*b* and 22*e* after sintering were both 60 μm.

Thereafter, a heating resistor paste and a paste for forming a power supply electrode and a conductive pattern were prepared. The heating resistor paste contains silver-palladium (Ag—Pd) as the conductive component, with a glass component and an organic binder component mixed thereto. The paste for forming the power supply electrode and the conductive pattern contains silver as the conductive component, with a glass component and an organic binder component mixed thereto. The respective pastes were applied to the stainless-steel substrate by screen printing, and then dried at 180° C. and sintered at 850° C. to form the heating element 22*c*, the power supplying electrode 22*f* and the conductive pattern 22*g*. After sintering, the thickness of the heating element 22*c* was 15 μm, the length was 220 mm and the width was 1.1 mm.

Next, the glass paste for the cover layer was prepared, and the glass paste for the cover layer was applied on the heating element 22*c* and the conductive pattern 22*g* by screen printing, and then dried at 180° C. and sintered at 850° C. to form the cover layer 22*d*. The thickness of the cover layer 22*d* after sintering was 60 μm.

(4) Mechanism of AC-Induced Banging

Next, an image defect, i.e., AC-induced banding, that occurs by the AC voltage of a commercial power supply 65 being superposed to a transfer voltage Vt at the transfer nip portion through a recording material P having absorbed moisture and having a low electric resistance when forming an image on the recording material P will be described with reference to FIGS. 7 to 10. The recording material P in the following description refers to an A4-size paper that has absorbed moisture by being left standing for a long time in a high temperature and high humidity environment, assuming a typical case where AC-induced banding occurs. In the case of the A4-size paper, a length regarding a conveyance direction of the recording material P is longer than 40 mm, that is, a distance from the transfer nip portion to the fixing nip portion according to the present embodiment.

Figure 7:
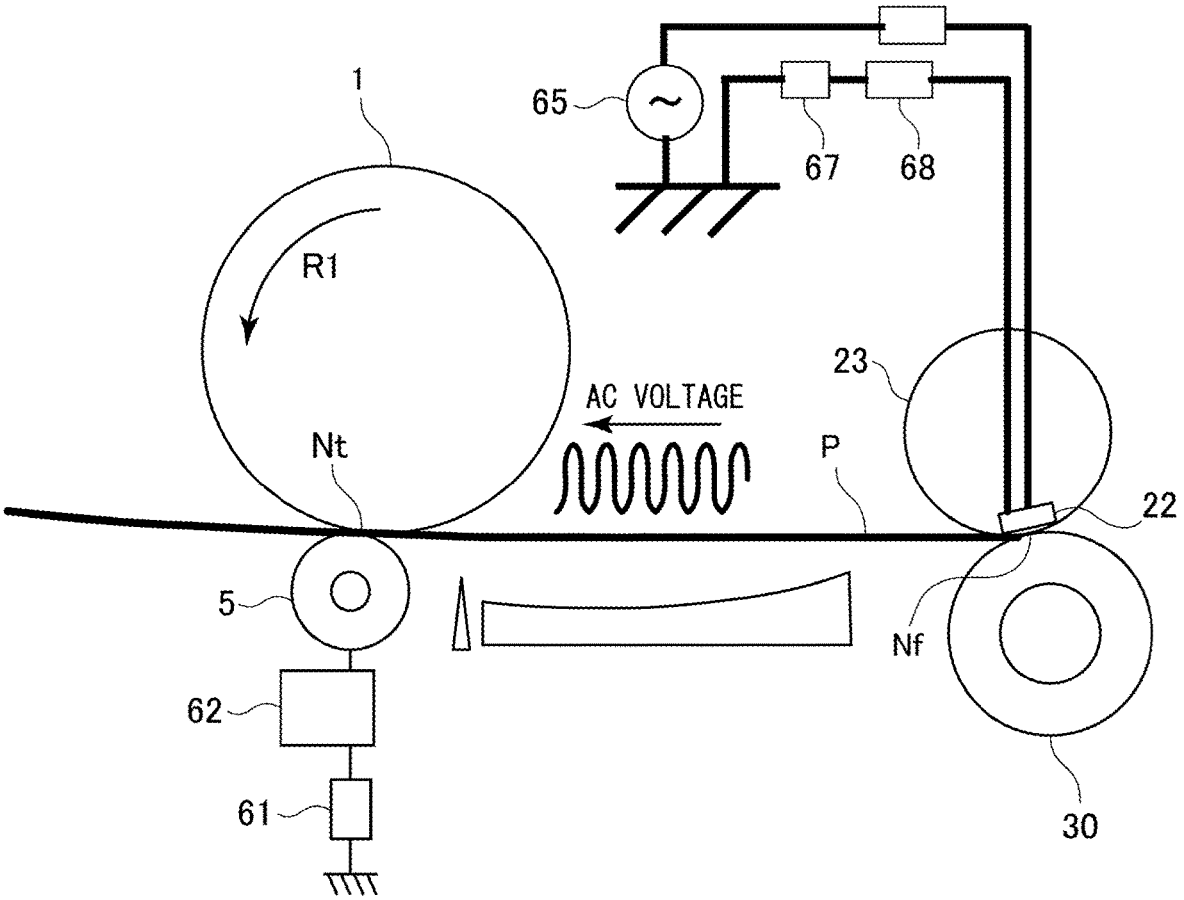
FIG. 7 is a schematic diagram illustrating a mechanism in which AC voltage derived from a fixing unit is superposed to a transfer voltage.

FIG. 7 is a schematic diagram illustrating a mechanism in which image defects are caused when the AC voltage of the commercial power supply 65 is superposed to the transfer voltage Vt at a transfer nip portion Nt. AC voltage is applied from the commercial power supply 65 serving as AC power supply to a heater 22 opposed to a fixing nip portion Nf. Further, transfer voltage is applied from a transfer power supply 61 to a transfer roller 5, and current flowing from the transfer roller 5 to the photosensitive member 1 at the transfer nip portion Nt is detectable by a detection circuit 62.

AC-induced banding occurs when the recording material P is nipped by the fixing nip portion Nf in a state where the recording material P having absorbed moisture is being subjected to transfer of toner image from the photosensitive member 1 at the transfer nip portion Nt. In this state, AC voltage (first AC voltage) is applied to the heater 22 from the commercial power supply 65, and waveform control of AC voltage is performed by a triac 68. The recording material P nipped by the fixing nip portion Nf is in contact with a fixing film 23, and the fixing film 23 is in contact with the heater 22 at the fixing nip portion Nf.

Figure 8A:
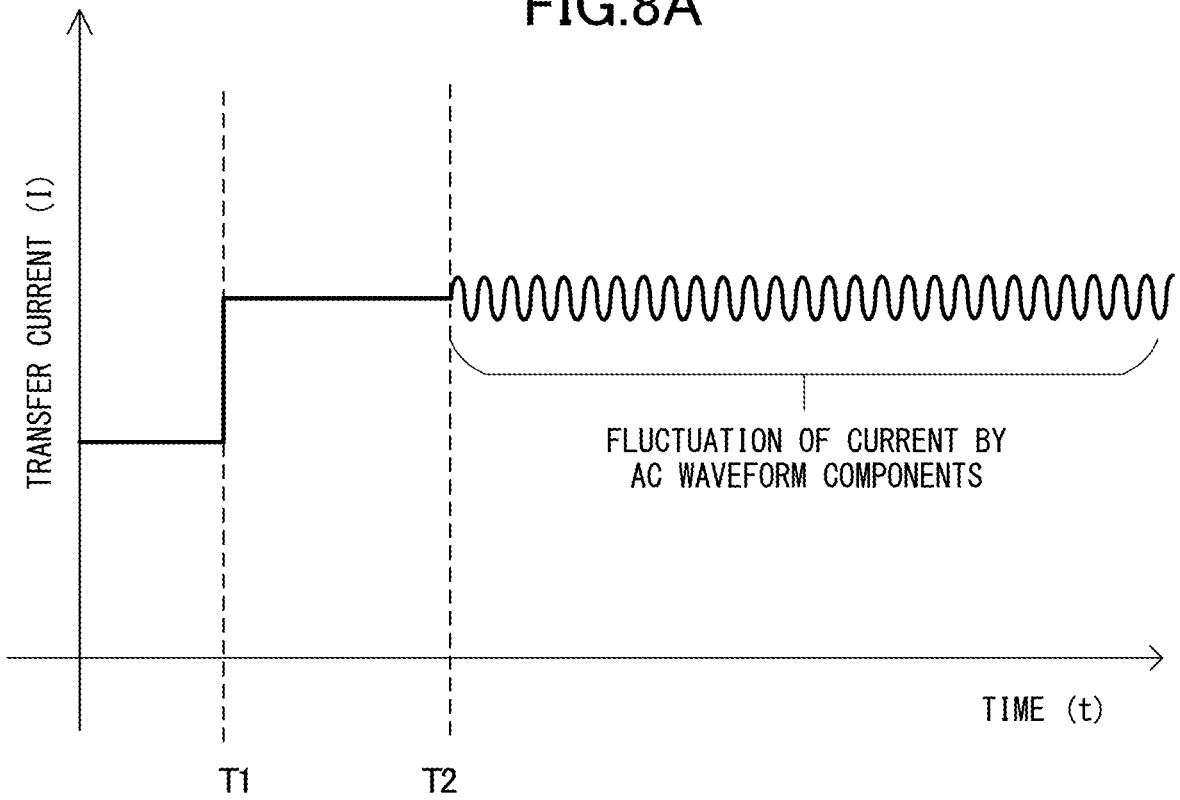
FIG. 8A is a graph illustrating AC waveform components in a transfer current.
Figure 8B:
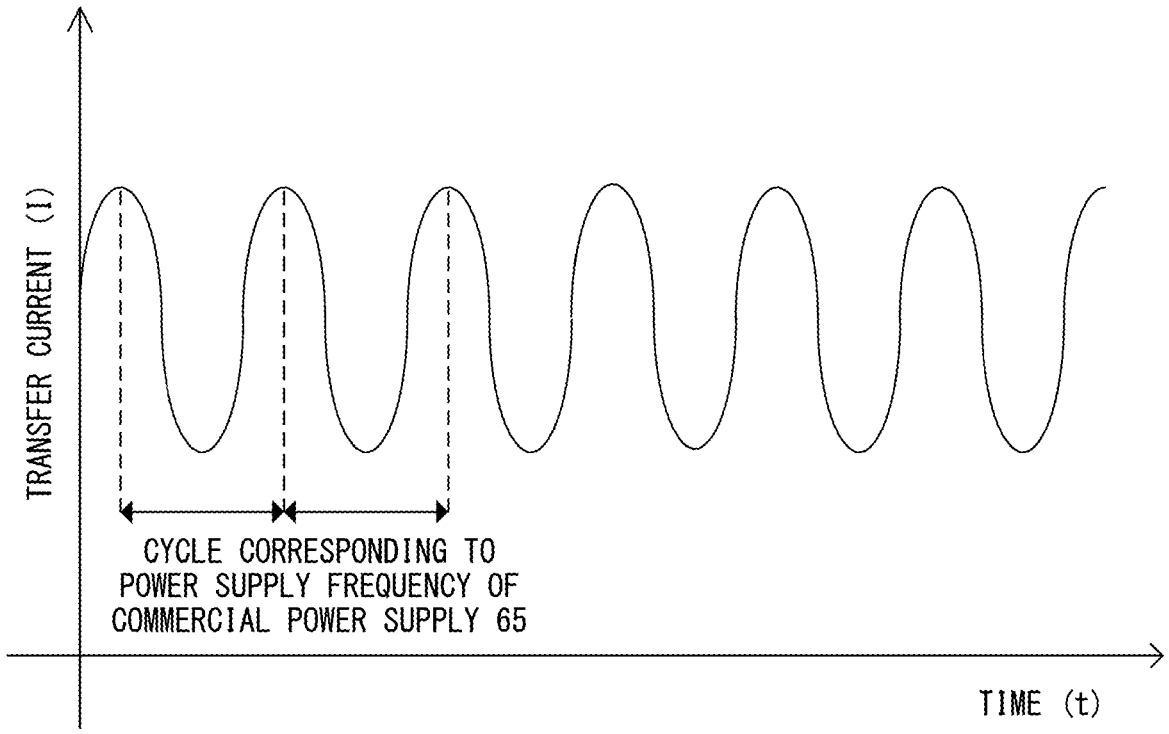
FIG. 8B is a graph having enlarged a portion of FIG. 8A.

As illustrated in FIGS. 8A and 8B, if the electric resistance of the recording material P is low, the AC voltage applied to the heater 22 fluctuates the transfer voltage Vt at the transfer nip portion Nt through the fixing film 23 and the recording material P. Thereby, the current flowing from the transfer roller 5 to the photosensitive member 1 is fluctuated by waveform components of the AC voltage from the commercial power supply 65 (hereinafter referred to as AC waveform components). FIG. 8A is a graph that illustrates the current detected by the detection circuit 62 when AC voltage from the commercial power supply 65 is superposed to the transfer voltage Vt at the transfer nip portion Nt. FIG. 8B is a graph having enlarged the waveform of the current fluctuated by the AC waveform components of FIG. 8A.

Time T1 of FIG. 8A is a time at which the recording material P enters the transfer nip portion Nt, and time T2 is a time at which the recording material P enters the fixing nip portion Nf Prior to time T2, the recording material P is in a state not nipped by both the transfer nip portion Nt and the fixing nip portion Nf, so that the AC voltage of the commercial power supply 65 is not superposed to the transfer voltage through the recording material P. Meanwhile, as for the time after time T2 where the recording material P is nipped by both the transfer nip portion Nt and the fixing nip portion Nf, the AC voltage of the commercial power supply 65 is superposed to the transfer voltage via the recording material P and the current value at the transfer nip portion Nt is fluctuated by the AC waveform components. Thereby, as illustrated in FIG. 8B, the current flowing to the transfer roller 5 is fluctuated by power supply frequency cycles of the commercial power supply 65.

Figure 9:
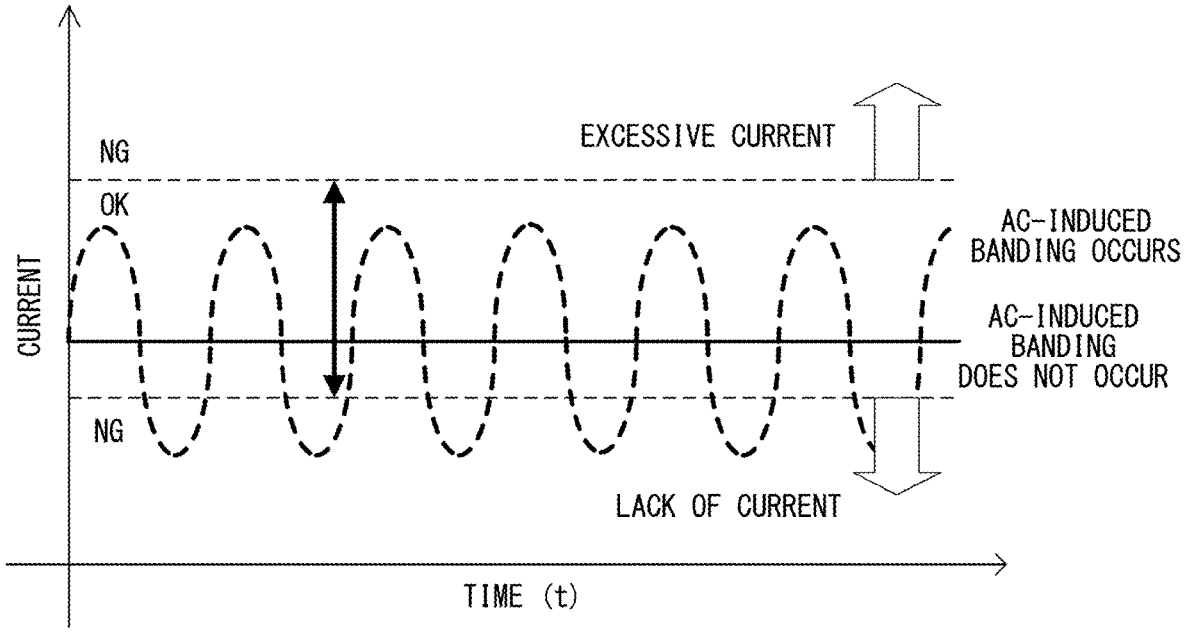
FIG. 9 is a graph illustrating the occurrence of AC-induced banding.
Figure 10:
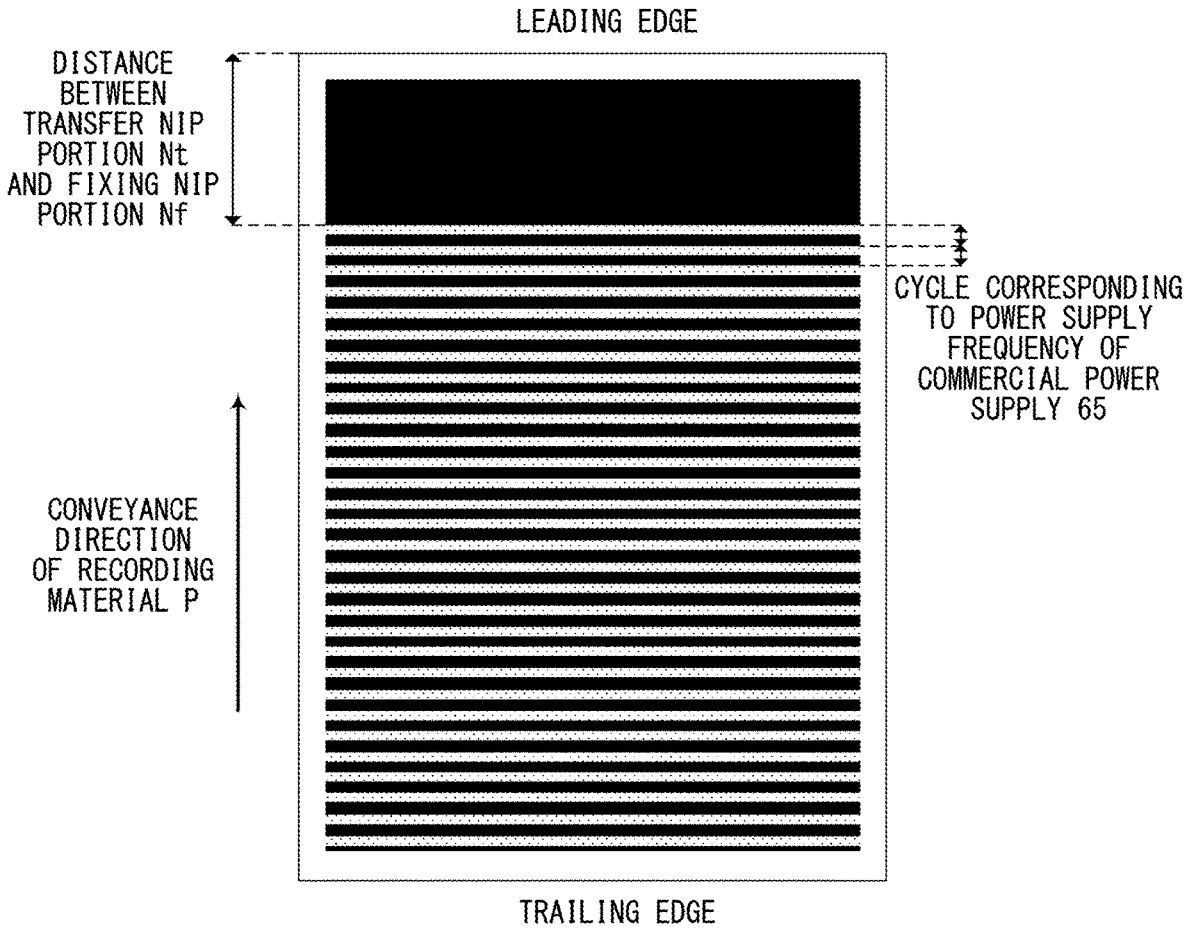
FIG. 10 is a schematic diagram illustrating an image when AC-induced banding has occurred.

FIG. 9 is a graph illustrating a case where AC-induced banding has actualized. FIG. 10 is a schematic diagram of an image with AC-induced banding.

As illustrated in FIG. 9, if AC voltage of the commercial power supply 65 is superposed to the transfer voltage Vt when transfer voltage Vt is applied from the transfer power supply 61 to the transfer roller 5, the current flowing from the transfer roller 5 to the photosensitive member 1 is fluctuated by AC waveform components. In this case, because the current flowing from the transfer roller 5 to the photosensitive member 1 is fluctuated by power supply frequency cycles of the commercial power supply 65, trough parts of the waveform of FIG. 9 will fall below a proper range of the current for transferring a toner image onto a paper having absorbed moisture. As a result, lack of current occurs in the power supply frequency cycle of the commercial power supply 65, and as illustrated in FIG. 10, the image transferred from the photosensitive member 1 to the recording material P after the recording material P has entered the fixing nip portion Nf will be an image that includes AC-induced banding where unevenness of density has occurred according to power supply frequency cycles of the commercial power supply 65.

Figure 11A:
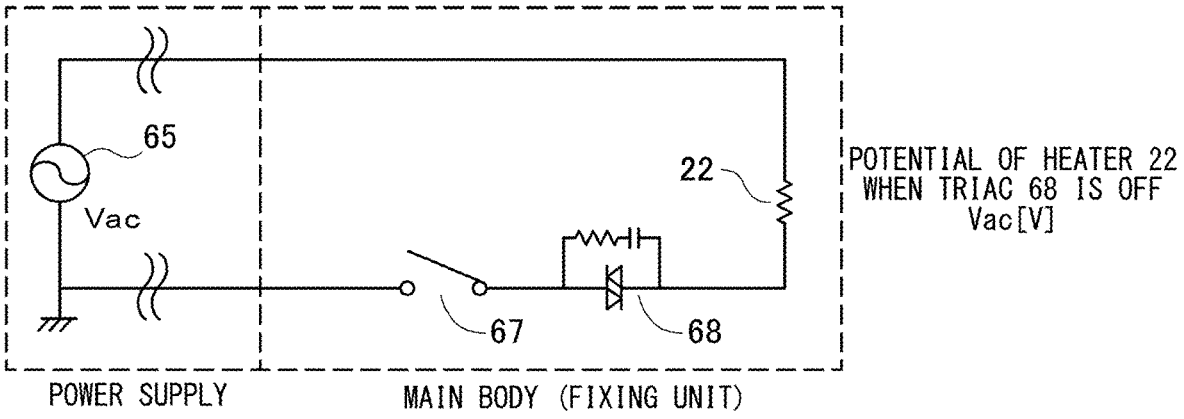
FIG. 11A is a schematic diagram illustrating a relationship between an insertion direction of a power plug to a commercial power supply and a heater potential when a triac is off.
Figure 11B:
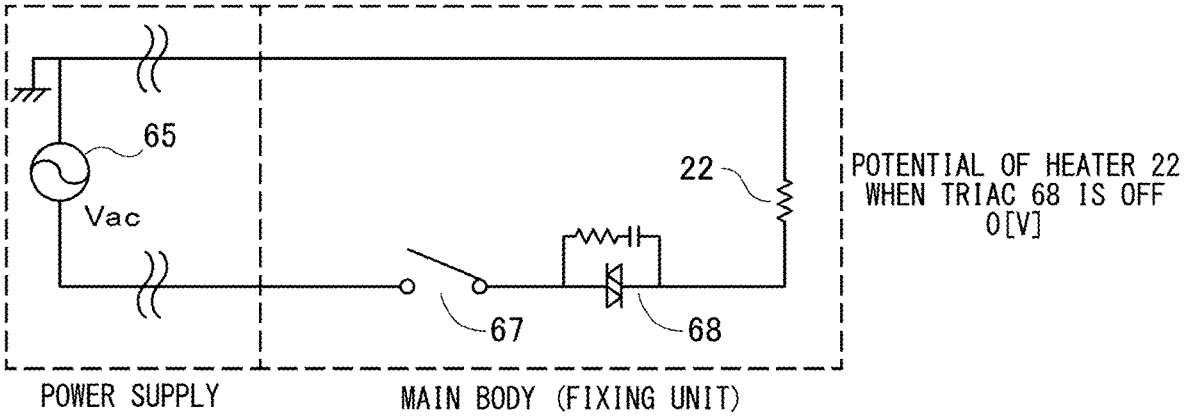
FIG. 11B is a schematic diagram illustrating a relationship between an insertion direction of a power plug to a commercial power supply and a heater potential when the triac is off.

With reference to FIGS. 11A and 11B, the tendency of occurrence of AC-induced banding being influenced by an insertion direction (insertion orientation) of a power plug to the commercial power supply 65 will be described. The "insertion direction of the power plug" refers to two directions (orientations) where a connection between two terminals on the printer and terminals on the commercial power supply side, which are a grounded side terminal and a non-grounded side terminal, are inverted.

FIGS. 11A and 11B illustrate a relationship between the heater 22 and grounded-side potential (a potential of the grounded side of the commercial power supply 65, GND) when the triac 68 is turned off in a case where the insertion direction of the power plug to the commercial power supply 65 has been changed. If the power plug is inserted in the direction of FIG. 11A, a voltage Vac of the commercial power supply 65 will exist between the heater 22 and the grounded-side potential (GND) even when the triac 68 has been turned off. Therefore, regardless of whether the triac 68 is turned on or off, the voltage Vac component of the commercial power supply 65 is constantly applied to the heater 22, so that an accumulated value of current that passes through the entire area of the heating element 22*c* becomes high and AC-induced banding tends to actualize.

Meanwhile, if the power plug is inserted in the direction shown in FIG. 11B, the potential of the heater 22 in a state where the triac 68 is turned off will be equal to grounded-side potential (GND). Therefore, the accumulated current value passing the entire area of the heating element 22*c* will be small compared to the case of FIG. 11A, so that AC-induced banding is not easily actualized.

If a switching element such as the triac 68 for switching the feeder circuit of the heating element 22*c* between an open state and a closed state is provided, there is a difference in the tendency of occurrence of AC-induced banding based on the position of the heating element 22*c* on the feeder circuit and the relationship of connection with the commercial power supply 65. According to the configuration of FIG. 11A where the heating element 22*c* is set to non-grounded-side potential when the circuit is in the open state, AC-induced banding tends to occur easily compared to the configuration of FIG. 11B where the heating element 22*c* is set to grounded-side potential when the circuit is in the open state.

(5) Driving Circuit of Heater

The present embodiment adopts a configuration where AC voltage (second AC voltage) is applied to a substrate 22*a* made of metal of the heater 22 as a method for reducing the above-mentioned AC-induced banding. That is, as illustrated in FIG. 6, a heater clip 28 serving as a fixing member for fixing the heater 22 to the heater holder 21 also serves as a voltage application member, i.e., potential application member, that applies voltage to the substrate 22*a*. Since the heater clip 28 serving as a fixing member also serves as a voltage application path, voltage application, i.e., potential application, to the substrate 22*a* is enabled by a relatively simple configuration. A bundle wire 29 extends from the heater clip 28, and the bundle wire 29 is connected to a voltage application circuit described later.

Figure 12A:
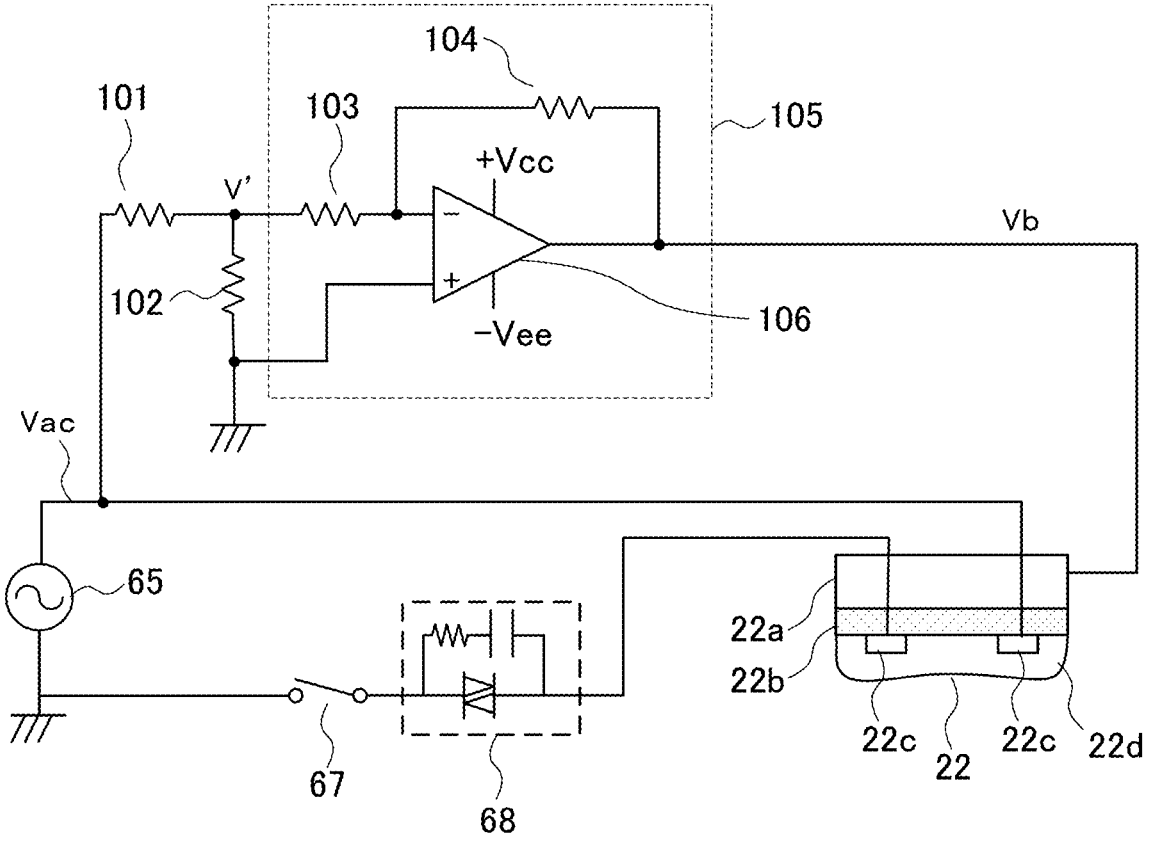
FIG. 12A is a diagram illustrating a configuration of a driving circuit of a heater according to the first embodiment.

The driving circuit of the heater 22 according to the present embodiment will be described with reference to FIG. 12A. A voltage of the commercial power supply 65 is converted through a resistor 101 and a resistor 102 so that the voltage Vac of the commercial power supply 65 is converted to a voltage V' having an absolute value of +Vcc and −Vee or less before being supplied to a power supply operational amplifier 106. For example, +Vcc is generated using a diode bridge not shown, and −Vee is generated using a DC converter of a power-supply output not shown. Further, resistance values of a resistor 103 and a resistor 104 are made uniform, so that an inverting amplifier 105 of gain −1 that outputs a voltage inverting the phase of V' is formed.

In other words, the inverting amplifier 105 having an operational amplifier constitutes a voltage application circuit that generates an AC voltage (Vb) having the same frequency as the AC voltage (Vac) supplied to the heating element 22*c* but with the phase inverted and applies the same to the substrate 22*a* of the heater 22. That is, at a point of time where the AC voltage (Vac) of the commercial power supply 65 applied to the heating element 22*c* takes a peak value, the AC voltage (Vb) applied to the substrate 22*a* takes a voltage value having an opposite polarity as Vac. The inverting amplifier 105 functions as a voltage application circuit according to the present embodiment that applies the AC voltage (Vb) to the substrate 22*a* of the heater 22 through the bundle wire 29 and the heater clip 28.

Figure 12B:
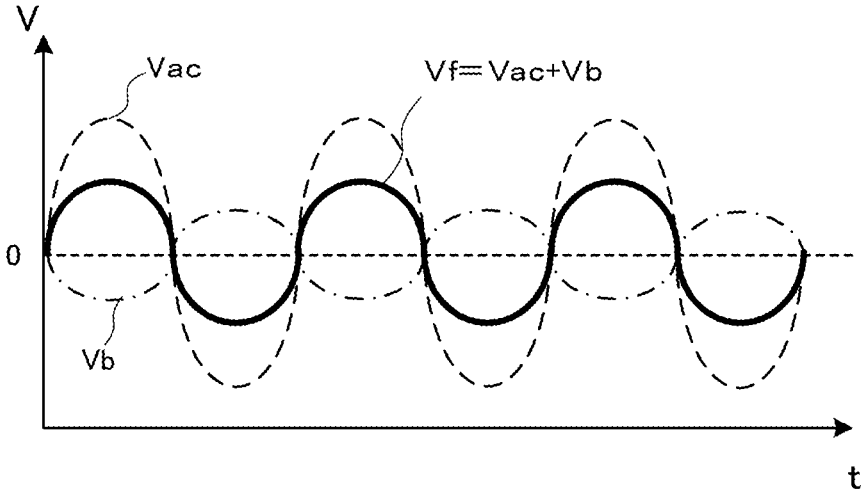
FIG. 12B is a graph illustrating a voltage applied to the recording material at a transfer nip portion.

As illustrated in FIG. 12B, it becomes possible to reduce the amplitude of AC waveform components Vf superposed to the transfer voltage Vt through the recording material P by applying a voltage Vb having an inverted phase as the commercial power supply 65 generated by the inverting amplifier 105. The recording material P not only receives the influence of voltage Vac applied to the heating element 22*c* but also the influence of voltage Vb applied to the substrate 22*a* at the fixing nip portion Nf, the AC waveform components Vf superposed to the transfer voltage Vt through the recording material P are reduced according to the size of Vb.

According to the circuit structure of the present embodiment, even in a case where the power plug is inserted in the direction of FIG. 11A, the AC waveform components Vf superposed to the transfer voltage Vt derived from the fixing unit are reduced. That is, even if the power plug is inserted in a direction where the potential of the heater 22 is set as the non-grounded side potential (Vac) of the commercial power supply 65 when the triac 68 is turned off by a relay 67, the occurrence of AC-induced banding can be suppressed.

The inverting amplifier 105 using an operational amplifier was used according to the present embodiment as the voltage application circuit for applying the voltage having an inverted phase as the commercial power supply 65 to the substrate 22*a*, but the AC voltage having an inverted phase as the commercial power supply 65 can also be generated using other known circuits.

A configuration where the driving circuit of the heater 22 is directly connected to the commercial power supply 65 has been illustrated in the present embodiment, but the present technique is also applicable to a case where the driving circuit is connected to another AC power supply.

Second Embodiment

Figure 13:
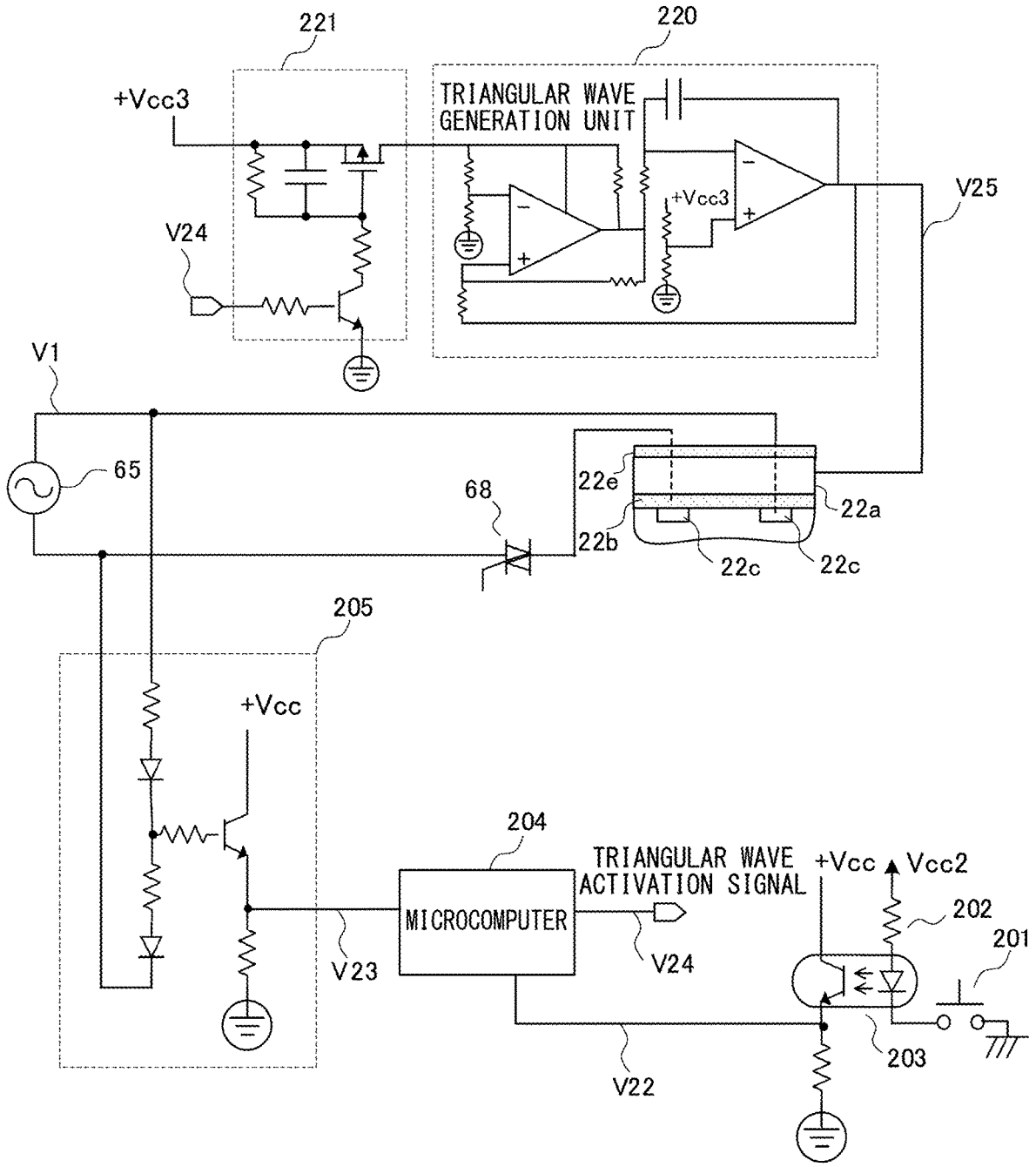
FIG. 13 is a view illustrating a configuration of a driving circuit of a heater according to a second embodiment.
Figure 14A:
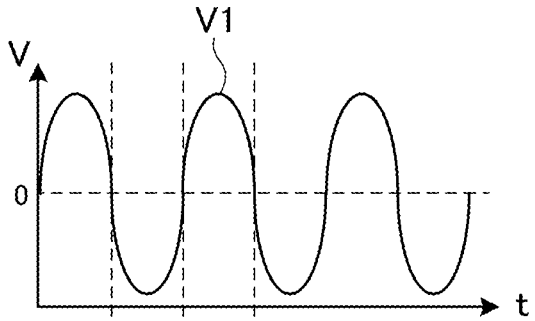
FIG. 14A is a graph illustrating a generation process of AC voltage applied to a substrate of the heater according to the second embodiment.
Figure 14B:
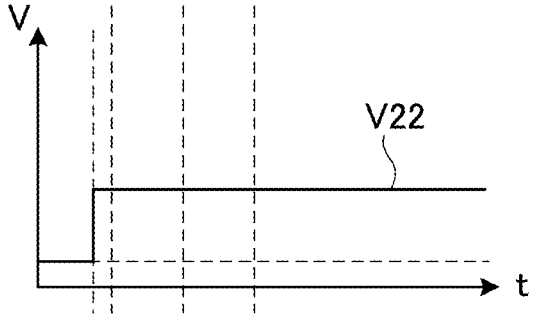
FIG. 14B is a graph illustrating a generation process of AC voltage applied to the substrate of the heater according to the second embodiment.
Figure 14C:
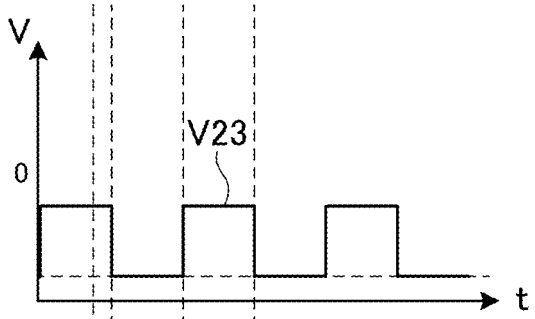
FIG. 14C is a graph illustrating a generation process of AC voltage applied to the substrate of the heater according to the second embodiment.
Figure 14D:
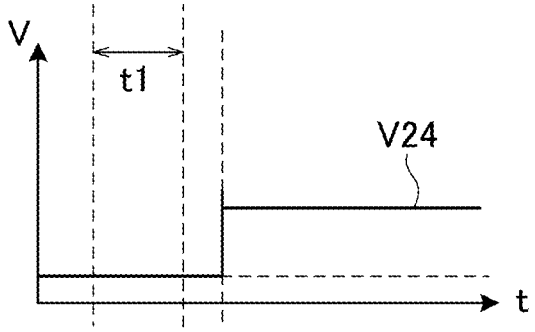
FIG. 14D is a graph illustrating a generation process of AC voltage applied to the substrate of the heater according to the second embodiment.
Figure 14E:
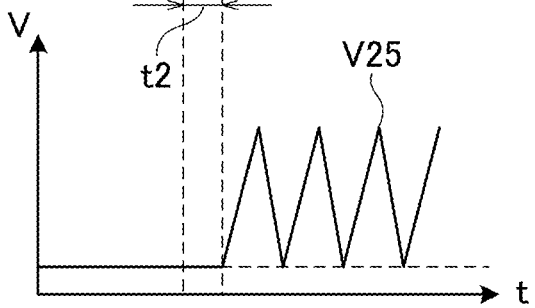
FIG. 14E is a graph illustrating a generation process of AC voltage applied to the substrate of the heater according to the second embodiment.

A fixing unit according to a second embodiment will be described with reference to FIGS. 13 to 15. FIG. 13 illustrates a driving circuit structure of a heater 22 according to the second embodiment. FIGS. 14A to 14E illustrate graphs illustrating a generation process of AC voltage applied to the heater 22 according to the second embodiment. A printer 100 and a fixing unit 9 according to the second embodiment adopt a similar configuration as the first embodiment except for the structure of the driving circuit of the heater 22, so that the same reference numbers as the first embodiment are assigned for such configuration and detailed descriptions thereof are omitted.

A main difference from the first embodiment is that a frequency of voltage applied to the substrate 22*a* differs from a frequency of the commercial power supply 65.

A voltage application circuit for applying voltage, i.e., applying potential, to the substrate 22*a* of the present embodiment will be described with reference to FIG. 13 and the graphs of FIGS. 14A to 14E. A zero-crossing detection circuit 205 connected to the commercial power supply 65 detects a zero-crossing point of voltage V1 (FIG. 14A) of the commercial power supply 65 and enters a zero-crossing signal V23 of rectangular waveform (FIG. 14C) to a microcomputer 204. Meanwhile, when a power switch 201 of the printer is turned on, a power-on signal V22 (FIG. 14B) is entered through a photocoupler 203 to the microcomputer 204.

The microcomputer 204 launches a triangular wave activation signal V24 (FIG. 14D) after elapse of time t1 from rise of the power-on signal V22 to rise of a next zero-crossing signal V23 and a certain period of time t2. The triangular wave activation signal V24 is entered to a triangular wave activation circuit 221 and a power supply voltage +Vcc3 is entered to a triangular wave generation unit 220, by which triangular waves V25 (FIG. 14E) are generated.

As described, triangular waves V25 are started to be applied to the substrate 22*a* after time t2 has elapsed from the rising of voltage V1 of the commercial power supply. The triangular wave generation unit 220 that generates triangular waves based on a synchronization signal (V22) of the microcomputer 204 and that applies the same to the substrate 22*a* of the heater 22 functions as the voltage application circuit of the present embodiment.

Figure 15A:
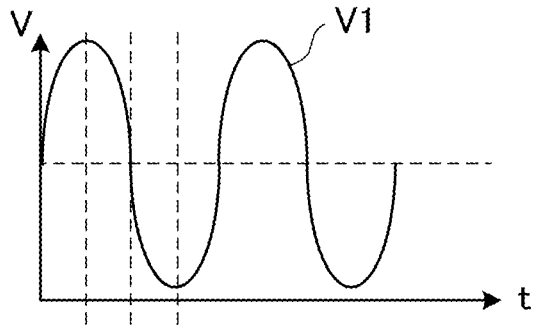
FIG. 15A is a schematic diagram illustrating a waveform of AC voltage superposed to a transfer voltage according to the second embodiment.
Figure 15B:
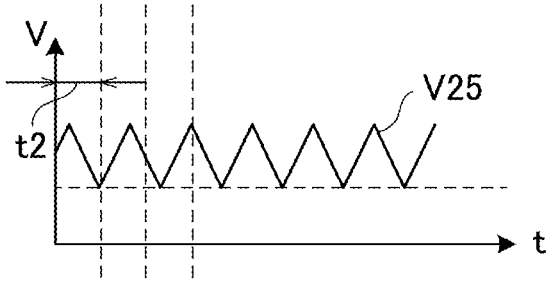
FIG. 15B is a schematic diagram illustrating a waveform of AC voltage superposed to the transfer voltage according to the second embodiment.
Figure 15C:
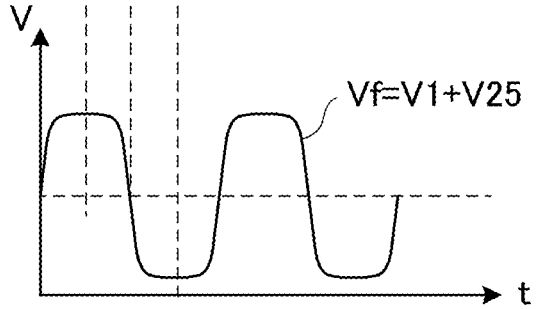
FIG. 15C is a schematic diagram illustrating a waveform of AC voltage superposed to the transfer voltage according to the second embodiment.

FIG. 15A illustrates the voltage V1 of the commercial power supply 65, FIG. 15B illustrates the triangular waves V25 to be applied to the substrate 22*a*, and FIG. 15C illustrates AC waveform components Vf superposed to the transfer voltage Vt through the recording material P. According to the present embodiment, time t2 is set as a time for the commercial power supply 65 to initially reach a peak voltage from a zero-crossing point, and the triangular waves V25 are set to have a frequency three times the frequency of the commercial power supply 65 by the triangular wave generation unit 220. Therefore, the waveform of the triangular waves V25 applied to the substrate 22*a* is set to be deviated by time t2 from the waveform of the voltage V1 applied from the commercial power supply 65 to the heating element 22*c*.

By setting the waveform to be superposed, which in this case is the triangular waves, to have a frequency of an odd number multiple of the reference frequency (of the commercial power supply) and adjusting the time t2, a maximum amplitude (i.e., peak-to-peak value) of the AC waveform components Vf as an associated wave can be suppressed. In other words, the frequency and phase of V25 are set so that the AC voltage (V25) applied to the substrate 22*a* takes a voltage value having an opposite polarity as V1 at each point of time when the AC voltage (V1) supplied from the commercial power supply 65 takes a peak value. Thereby, it becomes possible to reduce actualization of AC-induced banding.

According to the present embodiment, triangular waves that can be generated relatively easily are adopted as the AC voltage, and the frequency of the triangular peaks are set to three times the frequency of the commercial power supply, but other waveforms and frequencies can be adopted. The waveform of the AC voltage applied to the substrate 22*a* of the heater 22 can be directly generated from the commercial power supply using a converter circuit and an inverter circuit, for example.

Third Embodiment

Figure 16:
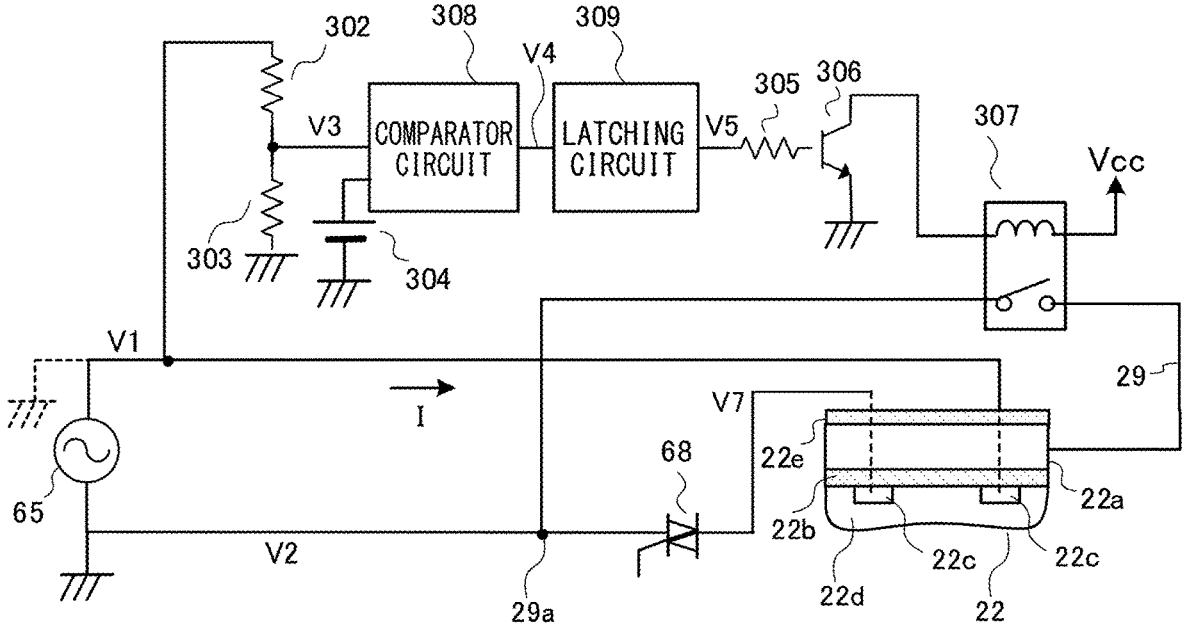
FIG. 16 is a view illustrating a configuration of a driving circuit of a heater according to a third embodiment.
Figure 17:
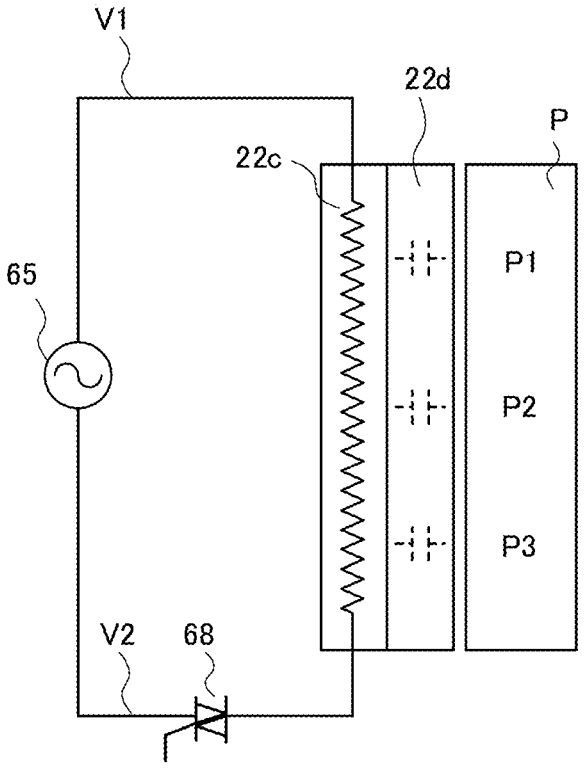
FIG. 17 is another view illustrating the configuration of the driving circuit of the heater according to the third embodiment.

A fixing unit according to a third embodiment will be described with reference to FIGS. 16 and 17. FIGS. 16 and 17 illustrate a driving circuit structure of the heater 22 according to the third embodiment. FIGS. 18A to 18I and FIGS. 19A to 19F are graphs illustrating a generation process of AC voltage to be applied to the heater 22 according to the third embodiment. The printer 100 and the fixing unit 9 of the third embodiment adopt a similar configuration as the first embodiment except for the driving circuit structure of the heater 22, so that the same reference numbers as the first embodiment are assigned and detailed descriptions thereof are omitted.

A main difference from the first embodiment is that a voltage applied to the substrate 22*a* is a voltage V2 of a first end (terminal) of the commercial power supply 65.

The flow of voltage V2 being applied to the substrate 22*a* will be described with reference to FIGS. 16 and 17. At first, a case where the voltage V1 is a sine wave, i.e., non-grounded side potential, and where the voltage V2 is 0 V, i.e., grounded side potential, as illustrated by the solid line of FIG. 16 will be described with reference to the respective graphs of FIG. 18.

The voltage V1 (FIG. 18F) is divided by resistors 302 and 303 into voltage V3 before being entered to a comparator circuit 308. The comparator circuit 308 compares a voltage 304 of DC power supply with the voltage V3 (FIG. 18G), and outputs a voltage V4 (FIG. 18H) that is set to high if the voltage V3 is greater and that is set to low if the voltage V3 is smaller than the voltage 304. The voltage V4 is entered to a latching circuit 309, and once the voltage V4 is set to high, the latching circuit 309 continuously outputs a voltage V5 (FIG. 18I) as a high signal. The comparator circuit 308 is composed of a known comparator and the latching circuit 309 is composed of a known transistor, for example.

In a state where the voltage V5 is set to high, current is flown through a transistor 305 to a relay 307 while turning on a transistor 306, so that the grounded side of the commercial power supply 65 and the substrate 22*a* are communicated. As described, if sine waves are detected in the voltage V1, 0 V is continuously supplied to the substrate 22*a*. In other words, once power is entered to the heater 22 in a state where the substrate 22*a* is connected to a grounded side circuit, a potential equivalent to grounded-side potential of the commercial power supply 65 is constantly applied to the substrate 22*a*.

A partial circuit that connects the substrate 22*a* and a feeder circuit through which electric power is conducted from the commercial power supply 65 to the heating element 22*c*, i.e., a path composed of the bundle wire 29 and the heater clip 28 of FIG. 6 extending from a contact 29*a* to the substrate 22*a* of FIG. 16, functions as a voltage application circuit, i.e., potential application circuit, of the present embodiment.

Now, taking a case where the triac 68 is turned on and off by a cycle equivalent to a cycle of the voltage V1 of the commercial power supply 65, the voltage being applied to the recording material P at the fixing nip portion Nf will be described with reference to the graphs of FIGS. 18A to 18E.

Figure 18A:
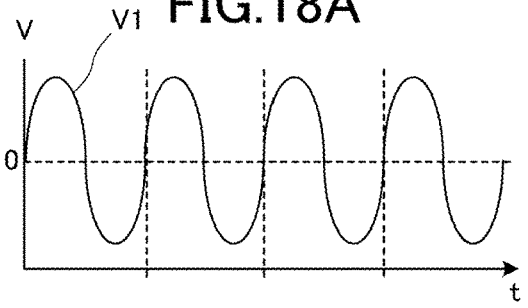
FIG. 18A is a schematic diagram illustrating a waveform and generation process of AC voltage applied to a substrate of the heater according to the third embodiment.
Figure 18B:
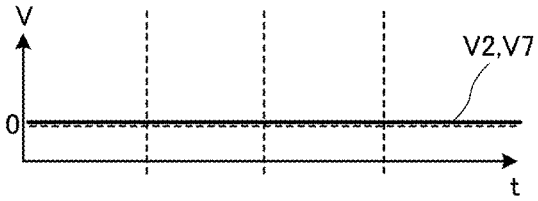
FIG. 18B is a schematic diagram illustrating a waveform and generation process of AC voltage applied to the substrate of the heater according to the third embodiment.
Figure 18C:
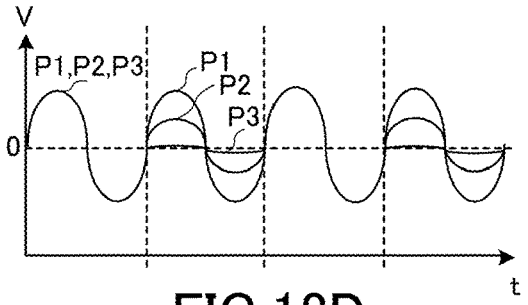
FIG. 18C is a schematic diagram illustrating a waveform and generation process of AC voltage applied to the substrate of the heater according to the third embodiment.
Figure 18D:
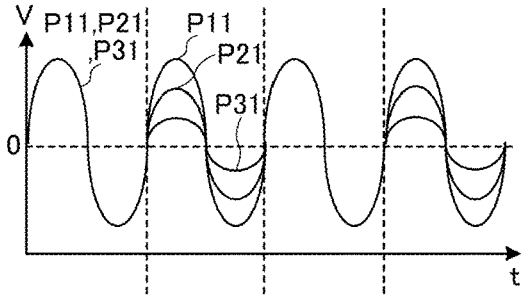
FIG. 18D is a schematic diagram illustrating a waveform and generation process of AC voltage applied to the substrate of the heater according to the third embodiment.
Figure 18E:
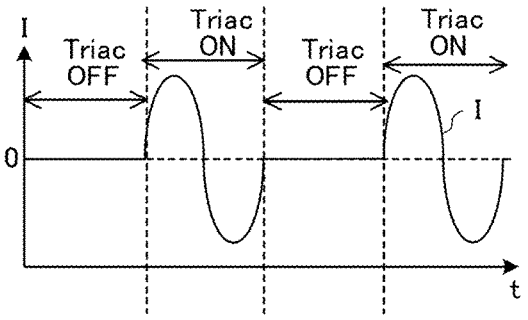
FIG. 18E is a schematic diagram illustrating a waveform and generation process of AC voltage applied to the substrate of the heater according to the third embodiment.
Figure 18F:
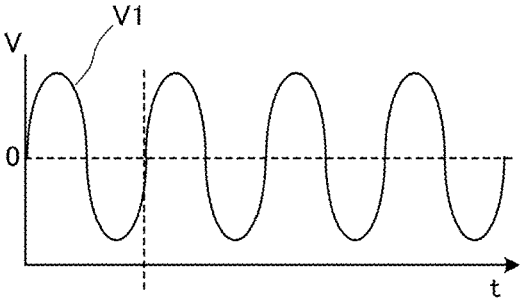
FIG. 18F is a schematic diagram illustrating a waveform and generation process of AC voltage applied to the substrate of the heater according to the third embodiment.
Figure 18G:
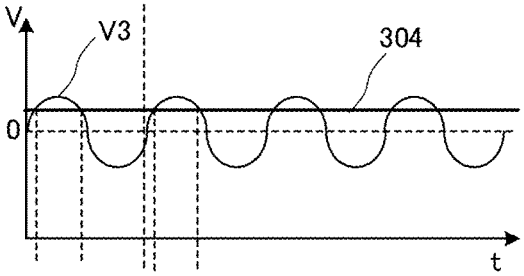
FIG. 18G is a schematic diagram illustrating a waveform and generation process of AC voltage applied to the substrate of the heater according to the third embodiment.
Figure 18H:
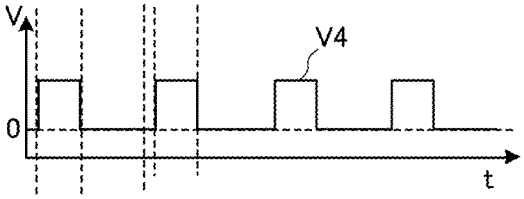
FIG. 18H is a schematic diagram illustrating a waveform and generation process of AC voltage applied to the substrate of the heater according to the third embodiment.
Figure 18I:
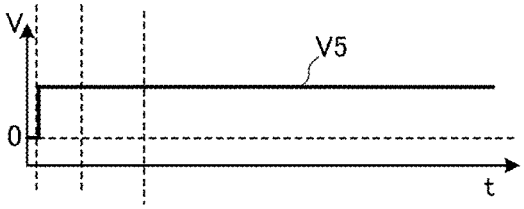
FIG. 18I is a schematic diagram illustrating a waveform and generation process of AC voltage applied to the substrate of the heater according to the third embodiment.

A case where the voltage V1 is the non-grounded side and the voltage V2 is the grounded side is considered, so that the graphs of V1, V2, V7 and the heater current I are as illustrated in FIGS. 18A, 18B and 18E. The triac 68 is assumed to be repeatedly turned off and on corresponding to two cycles of V1, as illustrated in FIG. 18E. According to the configuration of the third embodiment, the voltage applied to the recording material P at the respective longitudinal positions illustrated in FIG. 17 will be as illustrated in P1, P2 and P3 of FIG. 18C. In contrast, if the configuration of the third embodiment is not adopted, that is, if the voltage V2 is not applied to the substrate 22*a*, the voltage applied to the recording material P will be as those illustrated in P11, P21 and P31 of FIG. 18D. Here, the measurement positions of voltage P11, P21 and P31 correspond to measurement positions of voltages P1, P2 and P3.

By comparing voltages P1, P2 and P3 with voltages P11, P21 and P31 of FIGS. 18C and 18D, it can be recognized that the voltage conducted to the recording material P can be suppressed by applying 0 V to the substrate 22*a*. This is because (2) a path that from the heating element 22*c* through the substrate 22*a* to the grounded-side potential is added in parallel to (1) the path (FIG. 7) from the heating element 22*c* through the fixing nip portion Nf, the recording material P, the transfer nip portion Nt and the transfer roller 5 to the grounded-side potential. That is, according to the configuration of FIG. 7 that does not adopt the configuration of the third embodiment, amplitude of AC voltage applied to path (1) by the commercial power supply voltage is determined in accordance with a ratio of resistance of the heating element 22*c* and a combined impedance Z1 of path (1). When the combined impedance Z1 of the path (1) drops due to reasons such as absorption of moisture of the recording material P, the amplitude of AC voltage applied to the path (1) is also increased and AC-induced banding occurs. Meanwhile, since path (1) and path (2) are arranged in parallel at a position downstream of the heating element 22*c*, a combined impedance Z of the combined impedance Z1 of path (1) and an impedance Z2 of path (2) becomes smaller than the combined impedance Z1 of only path (1). As a result, the amplitude of AC voltage applied to path (1) is reduced, and the occurrence of AC-induced banding is suppressed. Incidentally, the impedance Z2 of path (2) corresponds to a capacity component between the heating element 22*c* and the substrate 22*a* that have been subjected to capacitive coupling through the insulating layer 22*b*.

Now, a behavior of a case illustrated by a dashed line of FIG. 16 where the driving circuit of the heater 22 is reversely connected to the commercial power supply 65, that is, where the comparator circuit 308 and the like are connected to the grounded side of the commercial power supply 65, will be illustrated in FIG. 19. FIG. 19 illustrates a case where the voltage V1 is set to 0 V, i.e., grounded side potential, and the voltage V2 becomes sine waves, i.e., non-grounded side potential. In this case, since the voltage V1 is 0 V as illustrated in FIG. 19F, the comparator circuit 308 and the latching circuit 309 will not be activated, and the transistor 306 and the relay 307 will be in an off state (V3=V4=V5=0 in FIG. 19F).

Figure 19A:
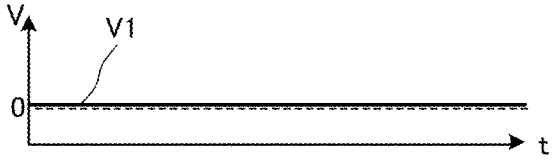
FIG. 19A is a schematic diagram illustrating a waveform and generation process of AC voltage applied to the substrate of the heater according to the third embodiment in a case where circuit connection circuit to a commercial power supply is inverted from a case of FIGS. 18A to 18I.
Figure 19B:
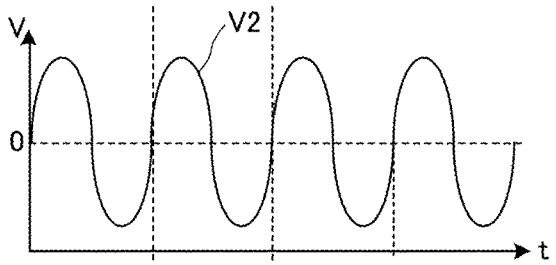
FIG. 19B is a schematic diagram illustrating a waveform and generation process of AC voltage applied to the substrate of the heater according to the third embodiment in the same case as FIG. 19A.
Figure 19C:
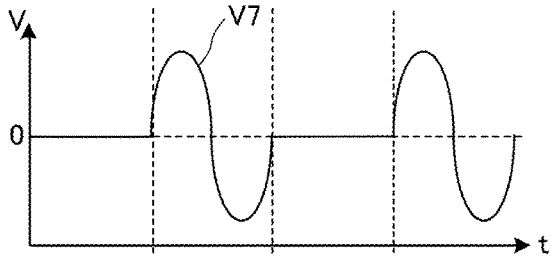
FIG. 19C is a schematic diagram illustrating a waveform and generation process of AC voltage applied to the substrate of the heater according to the third embodiment the same case as FIG. 19A.
Figure 19D:
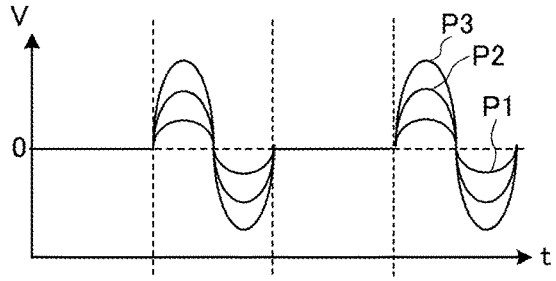
FIG. 19D is a schematic diagram illustrating a waveform and generation process of AC voltage applied to the substrate of the heater according to the third embodiment the same case as FIG. 19A.
Figure 19E:
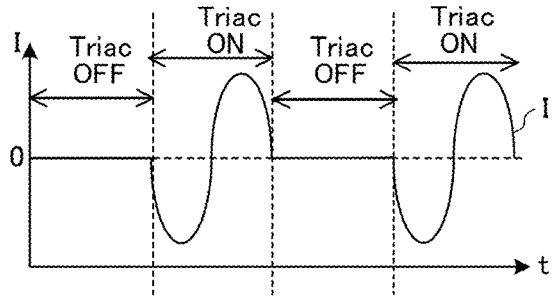
FIG. 19E is a schematic diagram illustrating a waveform and generation process of AC voltage applied to the substrate of the heater according to the third embodiment the same case as FIG. 19A.
Figure 19F:
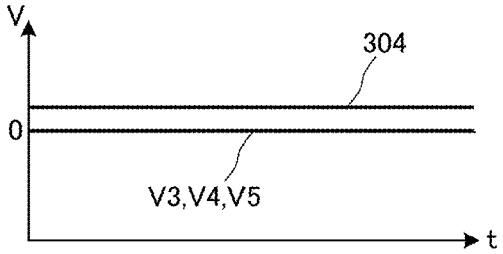
FIG. 19F is a schematic diagram illustrating a waveform and generation process of AC voltage applied to the substrate of the heater according to the third embodiment the same case as FIG. 19A.

If the triac 68 is turned on and off by a cycle equivalent to the cycle of the voltage V1 of the commercial power supply 65, the graphs of V1, V2, V7 and the heater current I will be as illustrated in FIGS. 19A, 19B, 19C and 19E. In this case, since the relay 307 is constantly in an off state, the substrate 22*a* will be in a floating state, and the effect of cancelling voltage application to the recording material P as illustrated in FIG. 19D will not occur. However, as described with reference to FIG. 11B, if the heating element 22*c* is connected to the grounded side of the commercial power supply 65 with respect to the triac 68, AC-induced banding is less actualized. Therefore, AC-induced banding can still be suppressed by adopting the configuration of the present embodiment.

In other words, the breaking circuit extending from the comparator circuit 308 to the relay 307 functions as a breaker for cutting off (floating) the substrate 22*a* and the contact 29*a* by the relay 307 in a state where the heating element 22*c* is connected to the grounded side of the commercial power supply 65 with respect to the triac 68.

Meanwhile, in a state where the heating element 22*c* is connected to the non-grounded side of the commercial power supply 65 with respect to the triac 68, as mentioned above, the relay 307 will be in a constantly on state, i.e., conducting state, and the substrate 22*a* is maintained at grounded-side potential.

The voltage applied to the substrate 22*a* is not necessarily a grounded-side potential of the commercial power supply 65, and it may be the grounded-side potential itself or a DC potential, i.e., DC voltage, with respect to the grounded-side potential. The configuration for applying voltage is not limited to the circuit structure of the present embodiment.

Result of Comparison with Comparative Example

The effects of the first, second and third embodiments will be described in comparison with a comparative example. A configuration where no voltage is applied to the substrate 22*a* is taken as a comparative example. In order to verify the effects of the first, second and third embodiments, presence of occurrence of AC-induced banding was confirmed using a recording material P having been left standing for a long time in a high temperature and high humidity environment. An image coverage pattern for evaluating AC-induced banding was a solid black pattern in which toner is applied to an entire surface of an effective image area, and a long-left paper that has been left standing for approximately one week after being unsealed was used as the recording material P. Since the test was performed under a high temperature and high humidity environment with a temperature of 32.5° C. and a humidity of 80%, moisture content of the recording material P was approximately 8%. Xerox Vitality (75 g/m$^2$, LTR) was used as the recording material P. A 240-V 50-Hz power supply was used as the commercial power supply 65 for evaluation. A voltage of 760 V was used as the transfer voltage Vt.

TABLE 1

| | AMPLITUDE Vpp OF AC VOLTAGE SUPERPOSED TO TRANSFER VOLTAGE DUE TO Vf | AC-INDUCED BANDING |
|---|---|---|
| FIRST EMBODIMENT | 30 V | GOOD (NO BANDING) |
| SECOND EMBODIMENT | 30 V | GOOD (NO BANDING) |
| THIRD EMBODIMENT | 30 V | GOOD (NO BANDING) |
| COMPARATIVE EXAMPLE | 60 V | POOR (BANDING HAS OCCURRED) |

Figure 20:
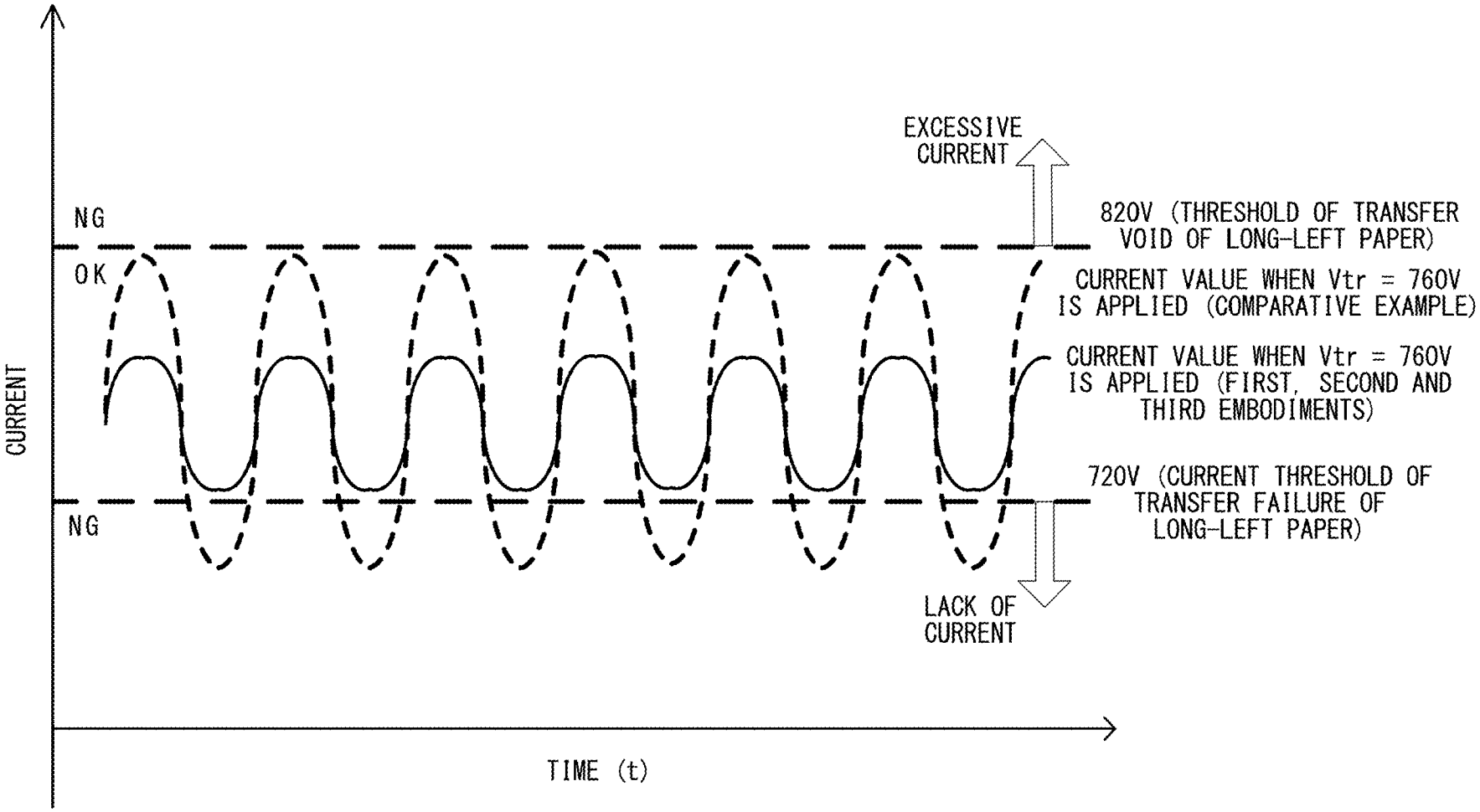
FIG. 20 is an image of a permissible range, i.e., margin of transfer image, of transfer current where AC-induced banding according to the first to third embodiments does not occur.

As illustrated in Table 1, in the case of long-left paper, an AC-induced banding image in correspondence with a 50-Hz cycle of power supply frequency has occurred from the position where the recording material P has entered the fixing nip portion Nf, i.e., 40 mm from a leading edge of the paper, to the rear end of the image. This is because the voltage Vac, which is 240 V, of the commercial power supply 65 that drives the heater 22 having been attenuated to approximately 60 V after passing through the heater 22, the fixing film 23 and the recording material P has been superposed to the voltage of the transfer nip portion Nt. As a result, the current flowing from the transfer roller, which is correlated with transfer property, to the drum is fluctuated as illustrated in FIG. 20. In the case of a comparative example, a transfer nip portion voltage Vnt is influenced by the commercial power supply 65, similar to a state where a voltage having an amplitude of approximately 60 V of amplitude (peak-to-peak voltage) Vpp is superposed to a transfer voltage (set voltage of transfer power supply) Vt of 760 V. In that case, the transfer nip portion voltage Vnt drops below a transfer voltage 720 V where transfer failure occurs in long-left paper in accordance with the voltage cycle of the commercial power supply 65, so that AC-induced banding has occurred in accordance with the power supply voltage cycle.

In the configuration of the first embodiment, the AC waveform component Vf derived from the fixing unit 9 superposed to the transfer voltage Vt through the recording material P was reduced from 60 V to 30 V by applying to the substrate 22*a* a voltage having inverted the phase of the voltage Vac of the commercial power supply 65. Therefore, a state was realized where voltage having an amplitude Vpp of approximately 30 V was superposed to the transfer voltage Vt of 760 V, by which the transfer nip portion voltage Vnt did not fall below the transfer voltage 720 V causing transfer failure, so that AC-induced banding did not occur.

In the configuration of the second embodiment, the AC waveform component Vf derived from the fixing unit 9 superposed to the transfer voltage Vt through the recording material P was reduced from 60 V to 30 V by adopting an AC waveform having a frequency that is three times the frequency of the commercial power supply 65 using triangular waves that are relatively easy to generate. Therefore, a state was realized where voltage having an amplitude Vpp of approximately 30 V was superposed to the transfer voltage Vt of 760 V, by which the transfer nip portion voltage Vnt did not fall below the transfer voltage 720 V causing transfer failure, so that AC-induced banding did not occur.

In the configuration of the third embodiment, the AC waveform component Vf derived from the fixing unit 9 superposed to the transfer voltage Vt through the recording material P was reduced from 60 V to 30 V by applying 0 V to the substrate 22*a* so as to suppress the voltage transmitted to the recording material P. Therefore, a state was realized where voltage having an amplitude Vpp of approximately 30 V was superposed to the transfer voltage Vt of 760 V, by which the transfer nip portion voltage Vnt did not fall below the transfer voltage 720 V causing transfer failure, so that AC-induced banding did not occur.

As described above, according to the first, second and third embodiments, the AC waveform component Vf of the voltage applied to the recording material P at the fixing nip portion can be reduced by applying to the substrate 22*a* a voltage having a waveform that differs from the voltage Vac of the commercial power supply 65 applied to the heating element 22*c*. According to the present embodiments, the occurrence of AC-induced banding can be suppressed since the AC waveform component Vf derived from the fixing unit 9 being superposed to the transfer voltage Vt through the recording material P can be reduced.

According to the embodiments described above, the heater 22 is directly in contact with the inner surface of the film in the fixing unit. However, a sheet-like member having a high thermal conductivity such as a sheet-like member formed of ferrous alloy or aluminum can be arranged between the heater and the inner surface of the film. In other words, a nip forming unit adopting a configuration where the heater heats the film through a sheet-like member can also be adopted.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-026805, filed on Feb. 20, 2020, which is hereby incorporated by reference herein in its entirety.

What is claimed is:

1. A fixing unit comprising:

a film with a tubular shape;

a nip forming unit comprising a heater and configured to be in sliding contact with an inner surface of the film, the heater comprising a substrate made of metal, an insulating layer formed on the substrate, and a heating element arranged on the insulating layer and configured to generate heat when a first AC voltage is applied from an AC power supply connected thereto;

a pressing member opposed to the nip forming unit with the film interposed therebetween and configured to form a nip portion with the film, wherein a recording material is nipped and conveyed by the nip portion so that an image formed by toner on the recording material is heated and fixed to the recording material; and a voltage application circuit configured to apply a second AC voltage to the substrate with a waveform that takes a voltage value of an opposite polarity to the first AC voltage when the first AC voltage takes a peak value.

2. The fixing unit according to claim 1, wherein the waveform of the second AC voltage has a same frequency as the first AC voltage and an inverted phase with respect to the first AC voltage.

3. The fixing unit according to claim 2, wherein the voltage application circuit comprises an inverting amplifier including an operational amplifier, and the second AC voltage is a voltage generated from the first AC voltage by the inverting amplifier.

4. The fixing unit according to claim 1, wherein the second AC voltage has a frequency that is an odd number multiple of a frequency of the first AC voltage.

5. The fixing unit according to claim 1, wherein the voltage application circuit is configured to synchronize the second AC voltage with the first AC voltage based on a zero-crossing signal of the first AC voltage.

6. An image forming apparatus comprising:

an image bearing member configured to rotate;

a transfer unit configured to transfer a toner image borne on a surface of the image bearing member to a recording material by having transfer voltage applied thereto; and the fixing unit according to claim 1 configured to fix the toner image having been transferred to the recording material by the transfer unit to the recording material.

7. A fixing unit comprising:

a film with a tubular shape;

a nip forming unit comprising a heater and configured to be in sliding contact with an inner surface of the film, the heater comprising a substrate made of metal, an insulating layer formed on the substrate, and a heating element arranged on the insulating layer and configured to generate heat when an AC voltage is applied from an AC power supply connected thereto;

a pressing member opposed to the nip forming unit with the film interposed therebetween and configured to form a nip portion with the film, wherein a recording material is nipped and conveyed by the nip portion so that an image formed by toner on the recording material is heated and fixed to the recording material; and a voltage application circuit configured to apply a constant DC voltage with respect to a potential of a grounded-side of the AC power supply or a voltage equivalent to the potential of the grounded-side of the AC power supply to the substrate.

8. The fixing unit according to claim 7, wherein the voltage application circuit is a partial circuit that connects the substrate and a feeder circuit through which the AC power supply feeds power to the heating element, the partial circuit being configured to maintain a potential of the substrate at the potential of the grounded-side of the AC power supply.

9. The fixing unit according to claim 8, further comprising:

a switching element provided on the feeder circuit and configured to control electric power supply to the heating element by switching the feeder circuit between an open state and a closed state; and a breaking circuit configured to set the partial circuit to a conducting state if the heating element is connected to the grounded-side of the AC power supply with respect to the switching element, and set the partial circuit to a breaking state if the heating element is connected to a non-grounded side of the AC power supply with respect to the switching element.

10. An image forming apparatus comprising:

an image bearing member configured to rotate;

a transfer unit configured to transfer a toner image borne on a surface of the image bearing member to a recording material by having transfer voltage applied thereto; and the fixing unit according to claim 6 configured to fix the toner image having been transferred to the recording material by the transfer unit to the recording material.

* * * * *